US008682218B2

(12) United States Patent
Yamaguchi et al.

(10) Patent No.: US 8,682,218 B2
(45) Date of Patent: Mar. 25, 2014

(54) FIXING DEVICE AND IMAGE FORMING APPARATUS INCORPORATING SAME

(75) Inventors: Yoshiki Yamaguchi, Kanagawa (JP); Masaaki Yoshikawa, Tokyo (JP); Kenji Ishii, Kanagawa (JP); Hiroshi Yoshinaga, Chiba (JP); Yuji Arai, Kanagawa (JP); Hiromasa Takagi, Tokyo (JP); Tetsuo Tokuda, Kanagawa (JP); Naoki Iwaya, Tokyo (JP); Yutaka Ikebuchi, Kanagawa (JP); Takuya Seshita, Kanagawa (JP); Ippei Fujimoto, Kanagawa (JP); Takahiro Imada, Kanagawa (JP); Hajime Gotoh, Kanagawa (JP); Toshihiko Shimokawa, Kanagawa (JP); Arinobu Yoshiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 158 days.

(21) Appl. No.: 13/315,704

(22) Filed: Dec. 9, 2011

(65) Prior Publication Data

US 2012/0155936 A1 Jun. 21, 2012

(30) Foreign Application Priority Data

Dec. 16, 2010 (JP) ..... 2010-280115

(51) Int. Cl.
*G03G 15/16* (2006.01)

(52) U.S. Cl.
USPC ..... 399/122; 399/329; 399/331

(58) Field of Classification Search
USPC ..... 399/122, 329
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |

(Continued)

FOREIGN PATENT DOCUMENTS

| | | |
|---|---|---|
| JP | 4-44075 | 2/1992 |
| JP | 8-262903 | 10/1996 |

(Continued)

OTHER PUBLICATIONS

Extended European Search Report issued Apr. 25, 2012, in Patent Application No. 11193232.3.

(Continued)

*Primary Examiner* — Benjamin Schmitt
(74) *Attorney, Agent, or Firm* — Oblon, Spivak, McClelland, Maier & Neustadt, L.L.P.

(57) ABSTRACT

A fixing device includes a tubular belt holder, a rotatable, flexible fuser belt, a heater, a fuser pad, a pressure member, and a reinforcing member. The fuser belt is looped for rotation around the belt holder. The heater is disposed adjacent to the belt holder to heat the belt holder. The fuser pad is accommodated in the belt holder inside the loop of the fuser belt, and extends in an axial direction of the belt holder. The pressure member is disposed opposite the belt holder with the fuser belt interposed between the fuser pad and the pressure member. The reinforcing member is disposed inside the loop of the fuser belt to reinforce the fuser pad under pressure from the pressure member. The fuser pad includes an elongated base, multiple longitudinally spaced protrusions, a perforated, anti-friction cover, and a fastener.

8 Claims, 12 Drawing Sheets

(56) References Cited

U.S. PATENT DOCUMENTS

| | | | | |
|---|---|---|---|---|
| 6,778,804 | B2 | 8/2004 | Yoshinaga et al. | |
| 6,813,464 | B2 | 11/2004 | Amita et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 7,022,944 | B2 | 4/2006 | Yoshinaga et al. | |
| 7,054,570 | B2 | 5/2006 | Kishi et al. | |
| 7,116,923 | B2 | 10/2006 | Kishi et al. | |
| 7,127,204 | B2 | 10/2006 | Satoh et al. | |
| 7,130,555 | B2 | 10/2006 | Kishi et al. | |
| 7,151,907 | B2 | 12/2006 | Yoshinaga | |
| 7,209,675 | B2 | 4/2007 | Matsusaka et al. | |
| 7,212,758 | B2 | 5/2007 | Kishi et al. | |
| 7,212,759 | B2 | 5/2007 | Kishi et a | |
| 7,239,821 | B2 | 7/2007 | Matsusaka et al. | |
| 7,239,838 | B2 | 7/2007 | Sato et al. | |
| 7,242,897 | B2 | 7/2007 | Satoh et al. | |
| 7,308,216 | B2 | 12/2007 | Kishi et al. | |
| 7,313,347 | B2 | 12/2007 | Shintani et al. | |
| 7,313,353 | B2 | 12/2007 | Satoh et al. | |
| 7,333,743 | B2 | 2/2008 | Kishi et al. | |
| 7,343,113 | B2 | 3/2008 | Matsusaka et al. | |
| 7,352,987 | B2 | 4/2008 | Iwata et al. | |
| 7,356,270 | B2 | 4/2008 | Matsusaka et al. | |
| 7,366,432 | B2 | 4/2008 | Kishi et al. | |
| 7,373,094 | B2 | 5/2008 | Kishi et al. | |
| 7,379,698 | B2 | 5/2008 | Yoshinaga | |
| 7,454,151 | B2 | 11/2008 | Satoh et al. | |
| 7,466,949 | B2 | 12/2008 | Satoh et al. | |
| 7,496,309 | B2 | 2/2009 | Matsusaka et al. | |
| 7,509,085 | B2 | 3/2009 | Yoshinaga et al. | |
| 7,515,845 | B2 | 4/2009 | Kishi et al. | |
| 7,546,049 | B2 | 6/2009 | Ehara et al. | |
| 7,551,869 | B2 | 6/2009 | Kishi et al. | |
| 7,565,087 | B2 | 7/2009 | Matsusaka et al. | |
| 7,570,910 | B2 | 8/2009 | Ishii | |
| 7,603,049 | B2 | 10/2009 | Kishi et al. | |
| 7,609,988 | B2 | 10/2009 | Kishi et al. | |
| 7,664,410 | B2 | 2/2010 | Takagi | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,840,151 | B2 | 11/2010 | Fujimoto | |
| 7,885,569 | B2 | 2/2011 | Kishi et al. | |
| 7,912,392 | B2 | 3/2011 | Yoshinaga et al. | |
| 7,925,177 | B2 | 4/2011 | Ishii et al. | |
| 7,953,338 | B2 | 5/2011 | Takagi | |
| 7,957,663 | B2 | 6/2011 | Kishi et al. | |
| 7,983,598 | B2 | 7/2011 | Shinshi et al. | |
| 8,023,861 | B2 | 9/2011 | Yoshinaga et al. | |
| 2005/0123315 | A1 | 6/2005 | Kishi et al. | |
| 2006/0051111 | A1 | 3/2006 | Kishi et al. | |
| 2006/0257183 | A1 | 11/2006 | Ehara et al. | |
| 2007/0014600 | A1 | 1/2007 | Ishii et al. | |
| 2007/0031159 | A1 | 2/2007 | Kishi et al. | |
| 2008/0063443 | A1 | 3/2008 | Yoshinaga et al. | |
| 2008/0226333 | A1 | 9/2008 | Ono et al. | |
| 2008/0317532 | A1 | 12/2008 | Ehara et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0169232 | A1 | 7/2009 | Kunii et al. | |
| 2010/0020809 | A1 | 1/2010 | Jones et al. | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1* | 8/2010 | Shinshi et al. | 399/329 |
| 2010/0290822 | A1* | 11/2010 | Hasegawa et al. | 399/329 |
| 2010/0303521 | A1 | 12/2010 | Ogawa et al. | |
| 2010/0303527 | A1 | 12/2010 | Mitsuoka | |
| 2011/0026987 | A1* | 2/2011 | Hasegawa | 399/329 |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0222938 | A1 | 9/2011 | Watanabe et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0274453 | A1 | 11/2011 | Shimokawa et al. | |
| 2011/0274474 | A1 | 11/2011 | Arai et al. | |
| 2011/0286758 | A1 | 11/2011 | Yoshinaga | |
| 2012/0121305 | A1* | 5/2012 | Yoshikawa et al. | 399/329 |
| 2012/0148303 | A1 | 6/2012 | Yamaguchi et al. | |

FOREIGN PATENT DOCUMENTS

| | | |
|---|---|---|
| JP | 10-213984 | 8/1998 |
| JP | 11-2982 | 1/1999 |
| JP | 2002-148985 | 5/2002 |
| JP | 2005-331578 | 12/2005 |
| JP | 2007-334205 | 12/2007 |
| JP | 2008-070747 | 3/2008 |
| JP | 2010-96782 | 4/2010 |

OTHER PUBLICATIONS

Communication issued Feb. 8, 2013 in European Patent Application No. 11 193 232.3.

* cited by examiner

FIXING DEVICE AND IMAGE FORMING APPARATUS INCORPORATING SAME

CROSS-REFERENCE TO RELATED APPLICATIONS

This patent application claims priority pursuant to 35 U.S.C. §119 to Japanese Patent Application No. 2010-280115, filed on Dec. 16, 2010, the entire disclosure of which is hereby incorporated by reference herein.

BACKGROUND

1. Technical Field

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, which employs such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

FIG. 1 is a schematic view of one example of a fixing device 220.

As shown in FIG. 1, the fixing device 220 includes a multi-roller, belt-based fuser assembly that employs an endless, flexible fuser belt 204 entrained around support rollers 202 and 203, paired with a pressure roller 205 that presses against the outer surface of the fuser belt 204 to form a fixing nip N therebetween. One of the belt support rollers (in this case, roller 202) is equipped with an internal heater 201, which heats the length of the fuser belt 204 through contact with the internally heated roller 202. As the fuser belt 204 and the pressure roller 205 rotate together, a recording sheet S is conveyed through the fixing nip N, at which a toner image on the incoming sheet S is fixed in place with heat from the fuser belt 204 and pressure from the pressure roller 205.

Although advantaged over a configuration that employs a conventional fuser roller instead of a fuser belt, the fixing device 220 described above involves a substantial warm-up time to heat the fixing nip to a temperature sufficient for fusing toner and first-print time to complete an initial print job upon activation. Prolonged warm-up time and first-print time required with the multi-roller belt fuser assembly limits application of the fixing device 220 to relatively slow imaging systems.

FIG. 2 is a schematic view of another example of a conventional fixing device 320.

As shown in FIG. 2, the fixing device 320 includes a film-based fuser assembly that employs a fuser belt 304 formed of thin heat-resistant film cylindrically looped around a stationary, ceramic heater 301, which is paired with a pressure roller 305 that presses against the stationary heater 301 through the fuser belt 304 to form a fixing nip N therebetween. As the pressure roller 305 rotates to in turn rotate the fuser belt 304, a recording sheet S is advanced into the fixing nip N, at which the stationary heater 301 heats the incoming sheet S via the fuser belt 304, so that a toner image is fixed in place with heat from the stationary heater 301 and pressure from the pressure roller 305.

Compared to the belt-based fuser assembly, the film-based fuser assembly is superior in terms of processing speed and thermal efficiency. Owing to the thin heat-resistant film which exhibits a relatively low heat capacity, the film-based fuser assembly can be swiftly heated, and therefore eliminates the need for keeping the heater in a sufficiently heated state when idle, resulting in a shorter warm-up time and smaller amounts of energy wasted during standby, as well as a relatively compact size of the fixing device. The film-based fixing device, thus overcoming the limitation of the belt-based fixing device, finds applications in high-speed, on-demand compact printers that can promptly execute a print job upon startup with significantly low energy consumption.

Although generally successful for its intended purpose, the fixing device employing a film-based fuser assembly also has drawbacks. One drawback is its vulnerability to wear, where the heat-resistant film has is repeatedly brought into frictional contact with the stationary ceramic heater. The frictionally contacting surfaces of the film and the heater readily chafe and abrade each other, which, after a long period of operation, results in increased frictional resistance at the heater/film interface, leading to disturbed rotation of the fuser belt, or increased torque required to drive the pressure roller. If not corrected, such defects can eventually cause imaging failures such as displacement of a printed image caused by a recording sheet slipping through the fixing nip, and damage to a gear train driving the rotary fixing members due to increased stress during rotation.

Another drawback is the difficulty in maintaining a uniform processing temperature throughout the fixing nip. The problem arises where the fuser film, which is once locally heated at the fixing nip by the heater, gradually loses heat as it travels downstream from the fixing nip, so as to cause a discrepancy in temperature between immediately downstream from the fixing nip (where the fuser belt is hottest) and immediately upstream from the fixing nip (where the fuser belt is coldest). Such thermal instability adversely affects fusing performance of the fixing device, particularly in high-speed applications where the rotational fixing member tends to dissipate higher amounts of heat during rotation.

Vulnerability to wear of a film-based fuser assembly has been addressed by an improved fixing device that uses a lubricant, such as a low-friction sheet of fiberglass impregnated with polytetrafluoroethylene (PTFE), to lubricate adjoining surfaces of a stationary pressure pad and a rotatable fixing belt. In this fixing device, the fixing belt is looped for rotation around the stationary pressure pad, while held in contact with an internally heated, rotatable fuser roller that has an elastically deformable outer surface. The he pressure pad is spring-loaded to press against the fuser roller through the fixing belt, which establishes a relatively large fixing nip therebetween as the fuser roller elastically deforms under pressure.

According to this arrangement, provision of the lubricant sheet prevents abrasion and chafing at the interface of the stationary and rotatable fixing members, as well as concomitant defects and failures of the fixing device. Moreover, the relatively large fixing nip translates into increased efficiency in heating a recording sheet by conduction from the fuser roller, which allows for designing a compact fixing device with reduced energy consumption.

However, even this improved method does not address the thermal instability caused by locally heating the fixing belt at the fixing nip. Further, this method involves a fixing roller that exhibits a higher heat capacity than that of a fixing belt or film, and therefore requires more time to heat the fixing member to a desired processing temperature during warm-up than would be otherwise required. Hence, although designed to provide increased thermal efficiency through use of an elastically deformable fuser roller, the method fails to provide satisfactory fixing performance for high-speed, on-demand applications.

To cope with the problems of the fixing device using a cylindrically looped, rotatable fixing belt, several methods have been proposed.

For example, one such method proposes a fuser assembly that employs a stationary, thermal belt holder or heat pipe including a thin-walled, hollow cylindrical tubular body of thermally conductive material or metal. A fuser belt is entrained around the belt holder while heated by a resistive heater such as a ceramic heater disposed in the hollow interior of the belt holder. A coating of lubricant may be deposited on an outer circumferential surface of the belt holder to allow smooth movement of the belt sliding against the belt holder.

According to this method, the thermal belt holder can swiftly conduct heat to the fuser belt, while guiding substantially the entire length of the belt along the outer circumference thereof. Compared to a stationary heater or heated roller that locally heats the fuser belt or film solely at the fixing nip, using the thermally conductive belt holder allows for heating the fuser belt swiftly and uniformly, providing the shorter warm-up times which meet high-speed, on-demand applications.

In a sophisticated arrangement, the belt holder may be used in conjunction with a stationary, fuser pad accommodated in the belt holder inside the loop of the fuser belt to support pressure from the pressure member to establish a fixing nip, as well as a reinforcing member that supports the fuser pad under pressure from the pressure member. Provision of the fuser pad and the reinforcing member allows for stable operation of the fixing device without variations in shape, dimensions, and/or strength of the fixing nip, which would occur where the belt holder itself were subjected to nip pressure, causing deformation and displacement of the thin-walled tubular body.

For example, such a fuser pad may include an elongated beam that defines a smooth surface on a front side thereof for contacting the pressure member via the fuser belt, and a contact portion on a rear side opposite the front side thereof for contacting the reinforcing member, with a thin covering of anti-friction material wrapped around the elongated beam for reducing friction between the fuser pad and the fuser belt.

Although also generally satisfactory for its intended purpose, the dimensional tolerances involved are so small that even a slight misalignment of the fuser pad against the fuser belt and opposed pressure member, such as that which may be caused by the thin anti-friction cover, can result in defective images.

BRIEF SUMMARY

Exemplary aspects of the present invention are put forward in view of the above-described circumstances, and provide a novel fixing device.

In one exemplary embodiment, the fixing device includes a tubular belt holder, a rotatable, flexible fuser belt, a heater, a fuser pad, a rotatably driven pressure member, and a reinforcing member. The fuser belt is looped for rotation around the belt holder. The heater is disposed adjacent to the belt holder to heat the belt holder to in turn heat the fuser belt. The fuser pad is accommodated in the belt holder inside the loop of the fuser belt, and extends in an axial direction of the belt holder. The pressure member is disposed opposite the belt holder with the fuser belt interposed between the fuser pad and the pressure member. The pressure member presses in a load direction against the fuser pad through the fuser belt to form a fixing nip therebetween, through which a recording medium travels under heat and pressure as the fuser belt and the pressure member rotate together. The reinforcing member is disposed inside the loop of the fuser belt to reinforce the fuser pad under pressure from the pressure member. The fuser pad includes an elongated base, multiple longitudinally spaced protrusion, a perforated, anti-friction cover, and a fastener. The elongated base defines a smooth surface on a front side thereof facing the pressure member. The multiple longitudinally spaced protrusions are on a rear side opposite of the elongated base opposite the front side thereof contacting the reinforcing member. The anti-friction cover is wrapped around the elongated base to reduce friction between the fuser pad and the fuser belt. The cover defines one or more openings for inserting therethrough the protrusions on the rear side of the elongated base. The fastener is disposed between the protrusions on the rear side of the elongated base to fasten the cover in position around the elongated base.

Other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
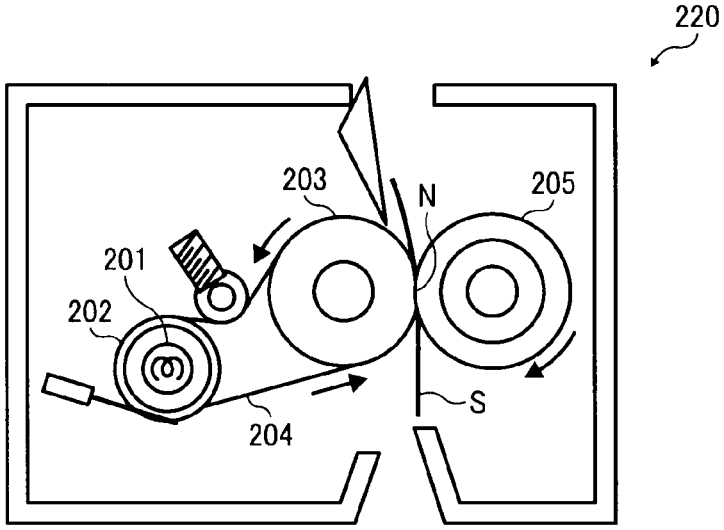
FIG. 1 BACKGROUND ART
FIG. 1 is a schematic view of one example of fixing device.
Figure 2:
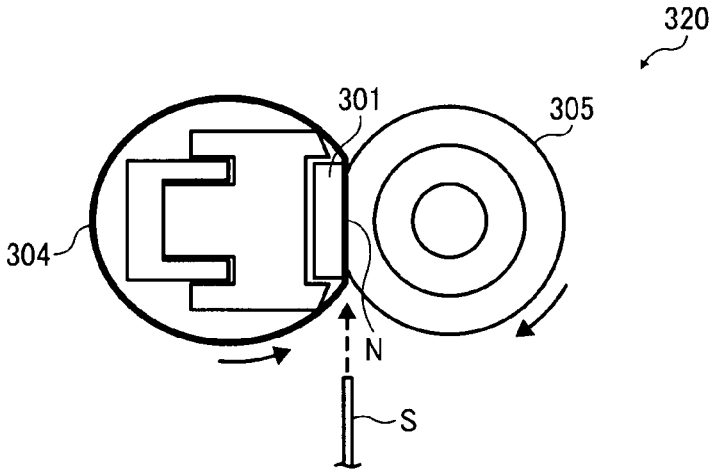
FIG. 2 BACKGROUND ART
FIG. 2 is a schematic view of another example of fixing device.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 3:
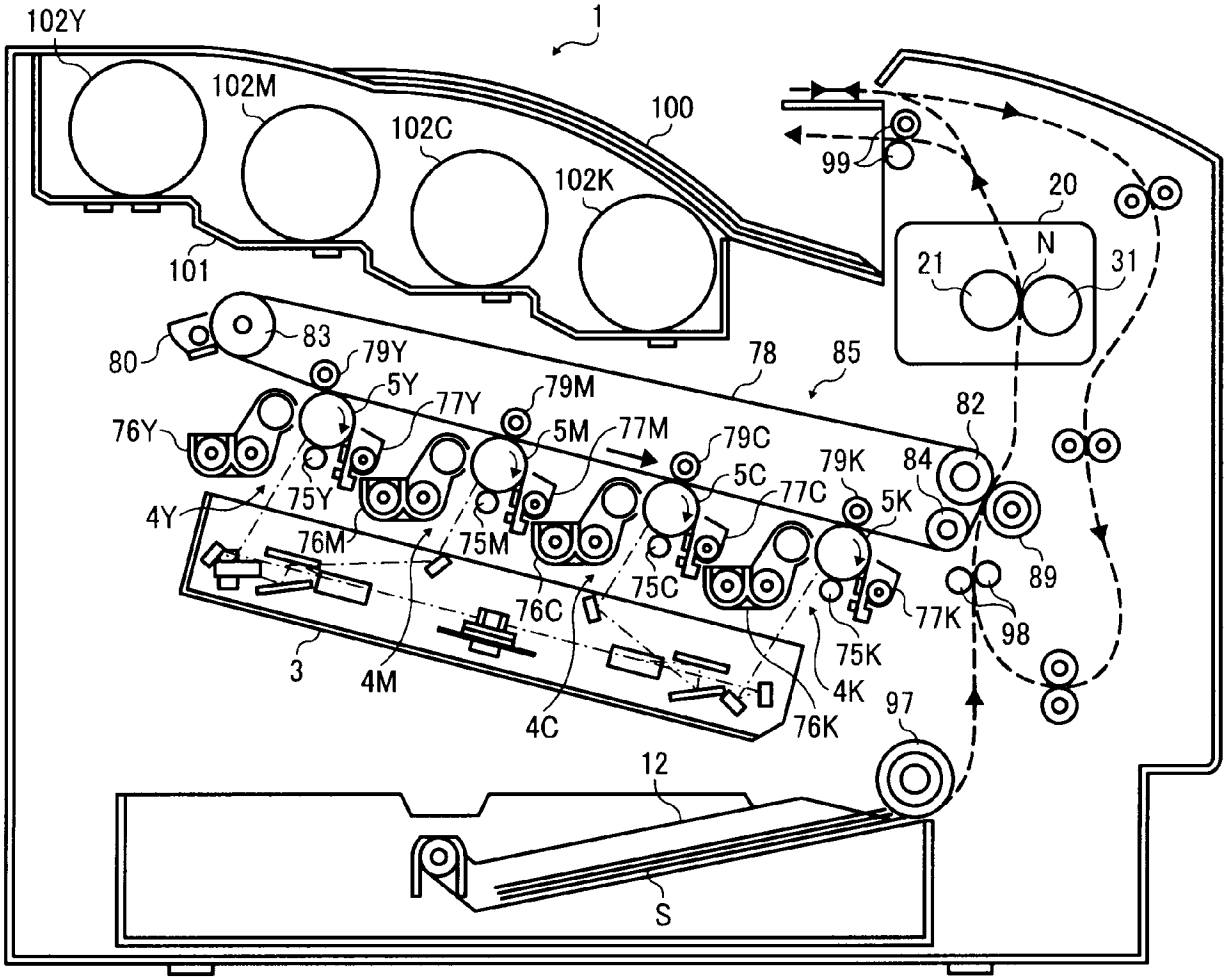
FIG. 3 schematically illustrates an image forming apparatus incorporating a fixing device according to one or more embodiments of this patent specification.

FIG. 3 schematically illustrates an image forming apparatus 1 incorporating a fixing device 20 according to one or more embodiments of this patent specification.

As shown in FIG. 3, the image forming apparatus 1 is a tandem color printer including four imaging stations 4Y, 4M, 4C, and 4K arranged in series along the length of an intermediate transfer unit 85 and adjacent to an exposure unit 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, and a discharging device, which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from detachably attached, replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 4 and subsequent drawings.

During operation, each imaging unit 4 rotates the photoconductor drum 5 clockwise in the drawing to forward its outer, photoconductive surface to undergo a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the exposure unit 3. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip between the intermediate transfer belt 78 and the primary transfer roller 79.

At the primary transfer nip, the primary transfer roller 79 is supplied with a bias voltage of a polarity opposite that of the toner on the photoconductor drum 5. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 4:
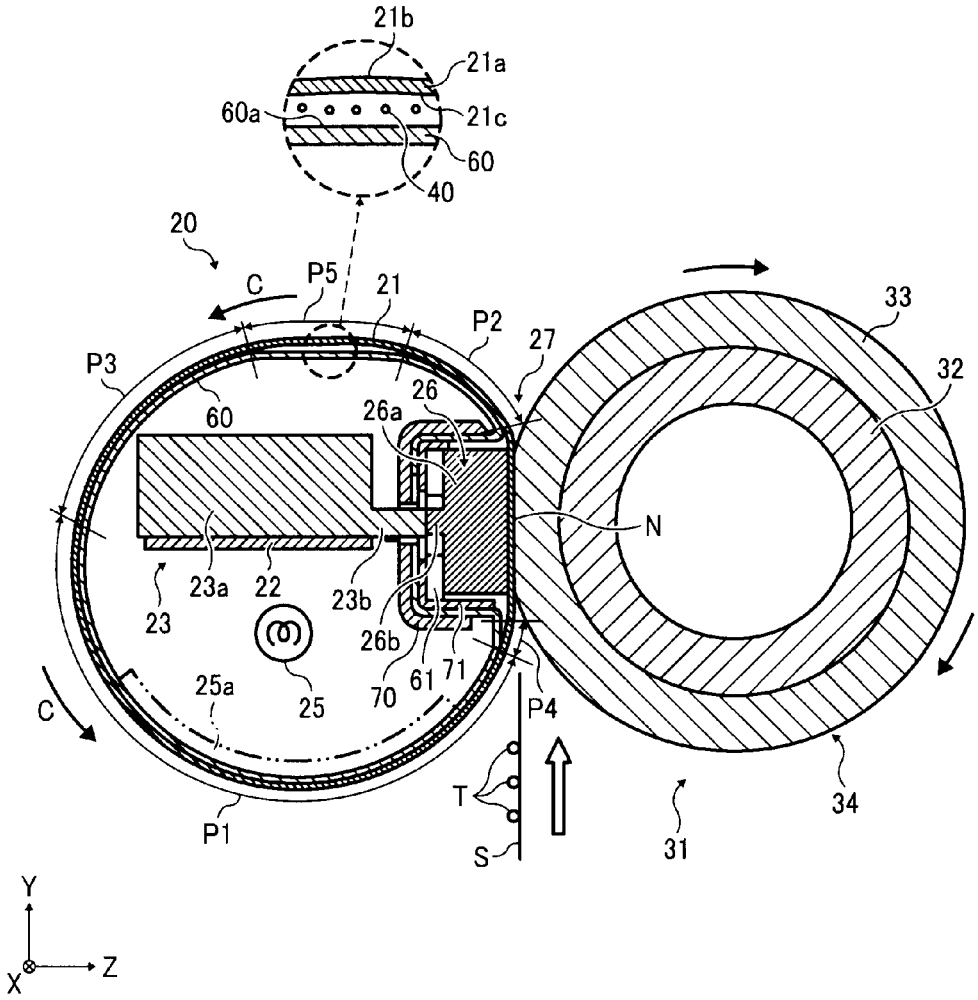
FIG. 4 is an end-on, axial cutaway view of the fixing device incorporated in the image forming apparatus of FIG. 3.

FIG. 4 is an end-on, axial cutaway view of the fixing device 20 incorporated in the image forming apparatus 1 according to one or more embodiments of this patent specification.

As shown in FIG. 4, the fixing device 20 includes a generally cylindrical, tubular belt holder 60 extending in an axial direction X thereof; a rotatable, flexible fuser belt 21 looped into a generally cylindrical configuration around the belt holder 60 to rotate in a circumferential direction C of the belt holder 60; a heater 25 disposed adjacent to the belt holder 60 to heat the belt holder 60 to in turn heat the fuser belt 21 through conduction; an elongated fuser pad 26 accommodated in the belt holder 60 inside the loop of the fuser belt 21, having a longitudinal central axis thereof extending in the axial direction X of the belt holder 60; and a rotatably driven pressure roller 31 disposed opposite the belt holder 60 with the fuser belt 21 interposed between the fuser pad 26 and the pressure roller 31. The pressure roller 31 presses in a load direction Z against the fuser pad 26 through the fuser belt 21 to form a fixing nip N therebetween, through which a recording sheet S travels in a conveyance direction Y under heat and pressure as the rotatable fixing members 21 and 31 rotate together. Inside the belt holder 60 is a stationary, reinforcing member 23 that reinforces the fuser pad 26 where the pressure roller 31 presses against the fuser pad 26.

Figure 5:
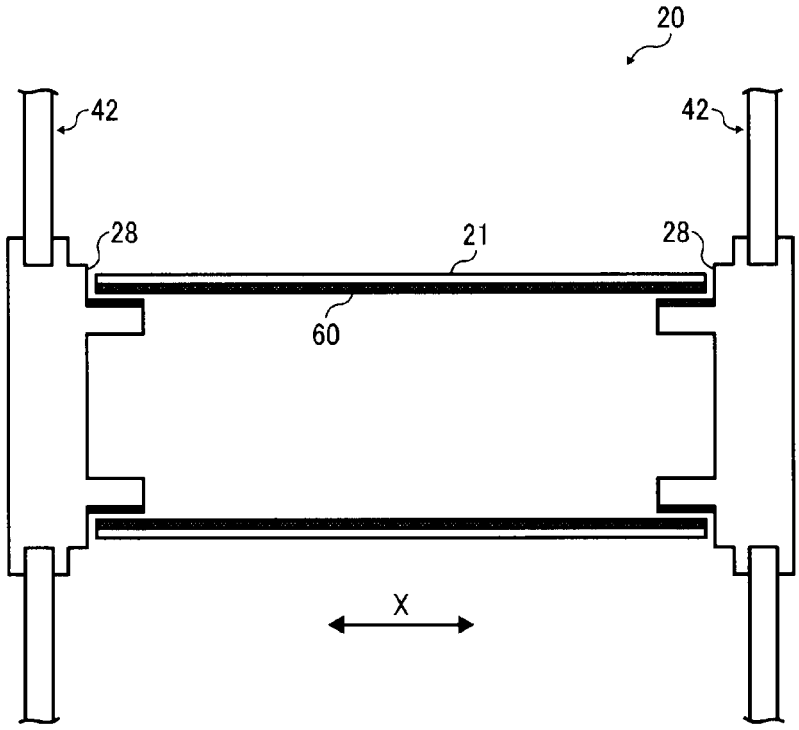
FIG. 5 is an axial cross-sectional view of a fuser belt assembly mounted in the fixing device of FIG. 4.

With additional reference to FIG. 5, which is an axial cross-sectional view of the fuser assembly mounted in the fixing device 20, the belt holder 60 is shown having its opposed longitudinal ends supported on a pair of sidewalls 42 of the fixing device 20 via a pair of mounting flanges 28 that holds the fuser belt 21 in position in the axial direction X. The mounting flanges 28 are shaped and dimensioned to engage with the fuser pad 26, the reinforcing member 23, and the heater 25 inside the loop of the fuser belt 21, so as to secure those internal components to the belt holder 60.

Figure 6:
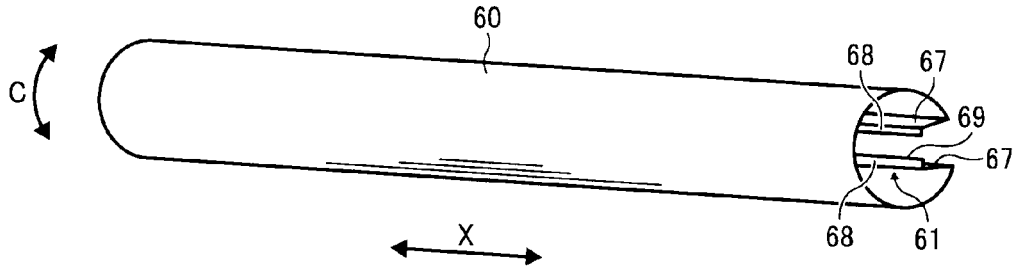
FIG. 6 is a perspective view of a tubular belt holder included in the fixing device of FIG. 4.

With still additional reference to FIG. 6, which is a perspective view of the belt holder 60 before assembly, the generally cylindrical, tubular body of the belt holder 60 is shown extending in the axial, longitudinal direction X and curved or rolled in the circumferential direction C.

As used herein, the term "axial direction X" refers to a direction parallel to a longitudinal, rotational axis of the tubular belt holder 60 around which rotates a generally cylindrical body, in particular, the fuser belt 21. The term "circumferential direction C" refers to a direction along a circumference of a generally cylindrical body, in particular, that of the fuser belt 21 or the belt holder 60. Also, the term "conveyance direction Y" refers to a direction perpendicular to the axial direction X, in which a recording medium is conveyed along the fixing nip N. The term "load direction Z" refers to a direction perpendicular to the axial direction X and the conveyance direction Y, in which the pressure member presses against the fuser pad to establish the fixing nip N. These directional terms apply not only to the fuser belt 21 and the belt holder 60 themselves but also to their associated structures, either in their operational position after assembly or in their unassembled, original forms before or during assembly.

During operation, upon initiation of image formation processes in response to a print request input by a user manipulating an operating panel or transmitted via a computer network, a rotary drive motor activates the pressure roller 31 to rotate clockwise in the drawing, which in turn rotates the fuser belt 21 counterclockwise in the drawing around the belt holder 60. The pressure roller 31 is equipped with a biasing mechanism that presses the pressure roller 31 in the load direction Z against the fuser pad 26 via the fuser belt 21 to form a fixing nip N therebetween.

Meanwhile, the power source starts supplying electricity to the heater 25, which then generates heat for conduction to the belt holder 60 to in turn heat the fuser belt 21 rotating therearound. Initiation of the heater power supply may be simultaneous with activation of the rotary drive motor. Alternatively, the two events precede or follow each other with an appropriate interval of time depending on specific configuration. Power supply to the heater 25 is adjusted according to readings of a thermometer disposed at a suitable location adjacent to the fuser belt 21, for example, along the inner circumferential surface of the belt holder 60 subjected to heating, so as to heat the fixing nip N to a given processing temperature sufficient for processing toner particles in use.

With the fixing nip N thus established, a recording sheet S bearing an unfixed, powder toner image T enters the fixing device 20 with its front, printed face brought into contact with the fuser belt 21 and bottom face with the pressure roller 31. As the fuser belt 21 and the pressure roller 31 rotate together, the recording sheet S moves in the conveyance direction Y through the fixing nip N, where the fuser belt 21 heats the incoming sheet S to fuse and melt the toner particles, while the pressure roller 31 presses the sheet S against the fuser pad 26 to cause the molten toner to settle onto the sheet surface.

Specifically, the fuser belt 21 comprises a flexible, endless belt of multilayered structure, consisting of a thermally conductive substrate 21*a* having one surface covered with an outer layer of release agent 21*b*, and another, opposite surface provided with an inner coating layer 21*c*, looped into a generally cylindrical configuration, approximately 15 mm to approximately 120 mm in diameter, so that the outer layer 21*b* faces the exterior of the loop and the inner layer 21*c* faces the interior of the loop. In the present embodiment, the fuser belt 21 is a multilayered endless belt having an outer diameter of approximately 30 mm in its looped, generally cylindrical configuration before assembly with the belt holder 60.

The belt substrate 21*a* may be formed of any thermally conductive material, approximately 30 μm to approximately 50 μm thick, which conducts sufficient heat for fusing toner on the recording medium. Examples of such material include, but are not limited to, iron, cobalt, nickel, or an alloy of such metals, as well as synthetic resin such as polyimide (PI).

The release layer 21*b* may be formed of any releasing agent deposited approximately 10 μm to approximately 50 μm thick on the substrate 21*a* for providing good release of toner where the fuser belt 21 comes into contact with the toner image T. Examples of such release agent include, but are not limited to, fluorine compound such as tetra fluoro ethylene-perfluoro alkylvinyl ether copolymer or perfluoroalkoxy (PFA), polytetrafluoroethylene (PTFE), polyimide (PI), polyetherimide (PEI), polyethersulfide (PES), or the like.

The coating layer 21*c* may be formed of any lubricant deposited on the substrate 21*a* for reducing friction between the fuser belt 21 and the belt holder 60. Examples of such lubricant include, but are not limited to, a low-frictional, anti-abrasive coating of PTFE, commercially available under the trademark Teflon®, metal plating, diamond-like carbon (DLC) coating, and glass coating.

The belt holder 60 comprises a longitudinally slotted tubular body having a generally circular, C-shaped cross-section, such as a thin-walled pipe of press-formed metal approximately 0.1 mm to approximately 1 mm thick, having a longitudinal side slot 61 in one side thereof for accommodating the fuser pad 26 therein, while retaining the fuser belt 21 therearound as the belt 21 rotates in the circumferential direction C of the belt holder 60.

The belt holder 60 has its outer, circumferential surface provided with a coating layer 60*a*. The coating layer 60*a* may be formed of any lubricant deposited on the tubular body for reducing friction between the fuser belt 21 and the belt holder 60. Examples of such lubricant include, but are not limited to, a low-frictional, anti-abrasive coating of PTFE, commercially available under the trademark Teflon®, metal plating, DLC coating, and glass coating. A lubricating agent 40, such as grease, may be deposited between the outer circumferential surface of the belt holder 60 and the inner circumferential surface of the fuser belt 21, so as to provide additional lubrication between the adjoining surfaces of the fuser belt 21 and the belt holder 60.

Figure 7:
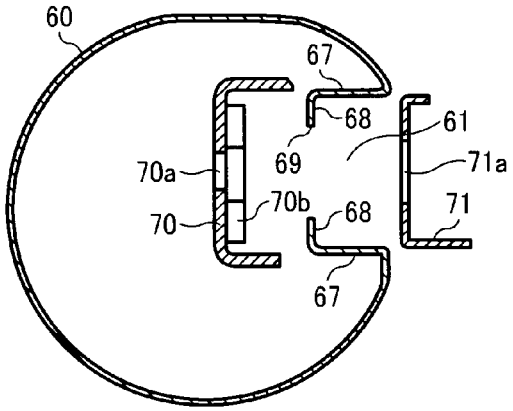
FIG. 7 is a cross-sectional view of the belt holder during assembly.
Figure 8:
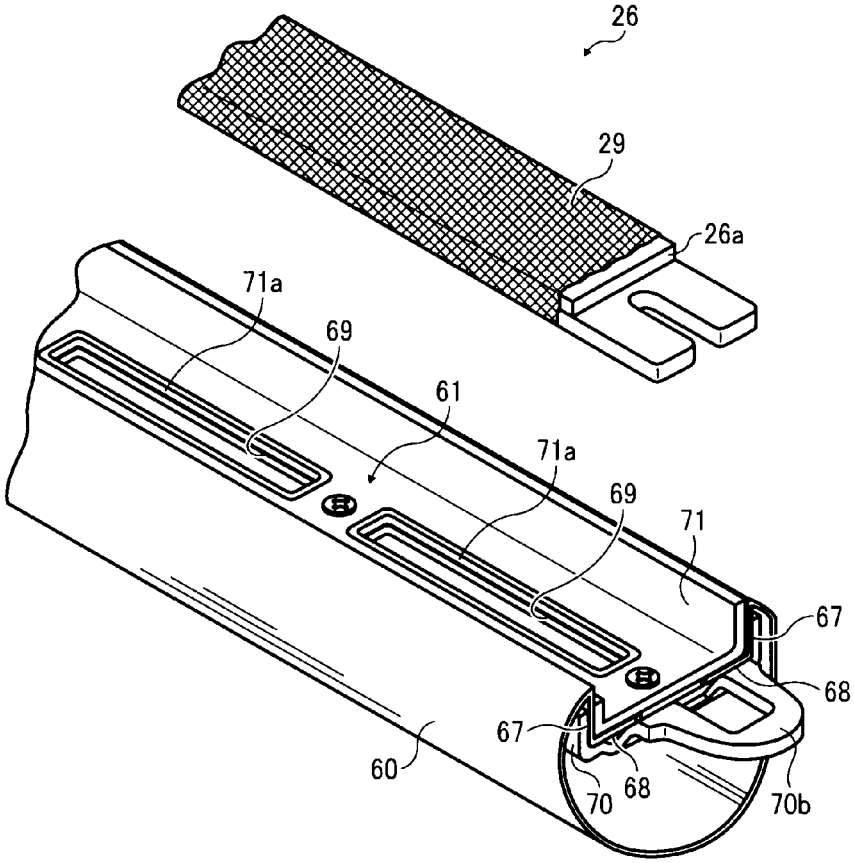
FIG. 8 is a perspective view of the belt holder during assembly.

With additional reference to FIGS. 7 and 8, which are cross-sectional and perspective views, respectively, of the belt holder 60 during assembly, the belt holder 60 is shown having its side slot 61 consisting of a pair of opposed parallel sidewalls 67 extending inward and bent toward each other to form a central, interior wall 68 therebetween with a longitudinal opening or slit 69 defined in the interior wall 68 to allow access from inside to outside the tubular body.

The belt holder 60 is provided with a pair of inner and outer, retaining stays 70 and 71 around the side slot 61, each being an elongated piece having a rectangular U-shaped cross-section, the former fitted along the inner surfaces of the holder 60 and the latter along the outer surfaces of the holder 60. The retaining stays 70 and 71 are screwed onto each other while clamping together the adjoining walls 67 and 68 therebetween, so as to retain the belt holder 60 in the proper, generally cylindrical configuration with its side slot 61 in shape.

The retaining stays 70 and 71 define longitudinal openings 70*a* and 71*a*, respectively, in their central walls facing the interior wall 68 of the side slot 61, each of which is aligned with the slit 69 of the side slot 68 to together define a through-hole which allows the reinforcing member 23 to extend outward from inside the belt holder 60 to contact the fuser pad 26 in the side slot 61. Also, the inner retaining stay 70 has its longitudinal ends provided with a pair of flanges 70*b* (of which only one is shown in FIG. 8), each adapted for connection with the mounting flange 28 to secure the stay 70 to the belt holder 60.

The fuser pad 26 comprises an elongated, substantially rectangular piece of heat-resistant elastic material, such as liquid crystal polymer (LCP), PI, polyamide-imide (PAI), dimensioned to be received within the outer stay 71 of the holder side slot 61, extending in the axial direction X of the belt holder 60.

Figure 9:
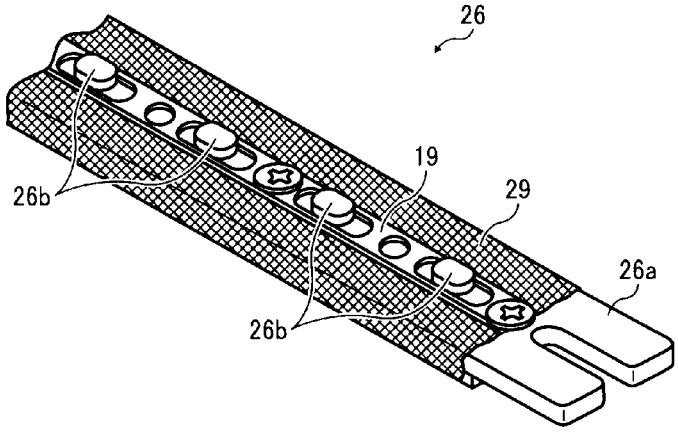
FIG. 9 is a perspective view of a fuser pad included in the fixing device of FIG. 4.

With additional reference to FIG. 9, which is a perspective view of the fuser pad 26 before assembly, the fuser pad 26 is shown including an elongated base 26*a* that defines a smooth surface on a front side of the fuser pad 26, and multiple longitudinally spaced, contact protrusions 26*b* on a rear side opposite the front side of the fuser pad 26. A covering 29 of anti-friction material, such as a web of PTFE fibers, is wrapped around the elongated base 26*a* for reducing friction between the fuser pad 26 and the fuser belt 21, with a perforated attachment 19 fitted around the protrusions 26*b* and screwed onto the elongated base 26*a* to secure the cover 29 in position.

The fuser pad 26 is inserted into the side slot 61 of the belt holder 60 with the front, smooth surface of the elongated base 26*a* facing outward and the multiple protrusions 26*b* facing inward of the tubular holder 60, so that the smooth surface of the base 26*a* slidably contacts the pressure roller 31 via the fuser belt 21 and the protrusions 26*b* contact the reinforcing member 23 through the openings 69, 70*a*, and 71*a* aligned with each other. The fuser pad 26 is secured in position on the belt holder 60 via the mounting flanges 28.

In such a configuration, the fuser pad 26 can support nip pressure from the pressure roller 31 without significant deformation and displacement in the load direction Z during operation, where the elongated base 26*a*, if slightly bent under pressure from the pressure roller 31, causes the protrusions 26*b* to contact the reinforcing member 23 to relieve undue pressure or stress therethrough. Although the fuser pad 26 in the present embodiment is configured with the elongated base 26*a* defining a substantially planar, flat surface facing the pressure roller 31, alternatively, instead, the smooth surface of the elongated base 26*a* may be formed in a concave configuration that can conform to the curved circumferential surface of the pressure roller 31 where the fuser pad 26 is subjected to nip pressure.

The reinforcing member 28 comprises an elongated, substantially rectangular piece of metal, dimensioned to be accommodated inside the tubular body of the belt holder 60, extending in the axial direction X of the belt holder 60.

Figure 10:
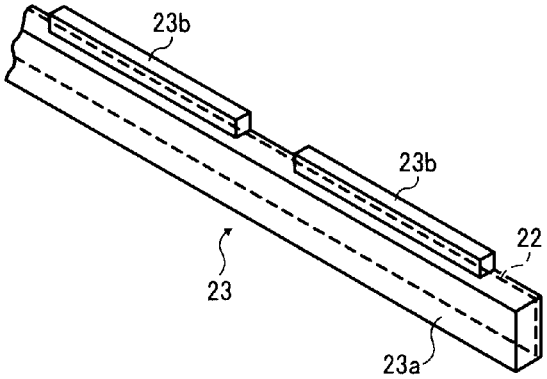
FIG. 10 is a perspective view of a reinforcing member included in the fixing device of FIG. 4.

With additional reference to FIG. 10, which is a perspective view of the reinforcing member 23 before assembly, the reinforcing member 23 is shown consisting of a rigid, elongated beam 23*a*; multiple contact portions or protrusions 23*b* disposed along the length of the beam 23*a* on a side to face the fuser pad 26; and a reflector plate or cover 22 disposed where the beam 23*a* faces the heater 25 upon assembly inside the tubular belt holder 60.

The reinforcing member 23 is inserted into the belt holder 60 with the contact protrusions 23*b* extending outward through the aligned openings 70*a*, 69, and 71*a* to contact the contact protrusions 26*b* on the rear side of the fuser pad 26. The reinforcing member 23 is secured in position on the belt holder 60 via the mounting flanges 28.

In such a configuration, the reinforcing member 23 supports the fuser pad 26 under pressure from the pressure roller 31, wherein the rigid beam 23*a* receives nip pressure on the rear side of the fuser pad 26 transmitted through the contact portions 26*a* and 23*b* from the elongated base 26*a* of the fuser pad 26. The reflector cover 22 serves to reflect radiation from the heater 25 inside the belt holder 60, so as to prevent an undue amount of heat from being dissipated in the rigid beam 23*a*.

Provision of the openings 69, 70*a*, and 71*a* enables the contact protrusions 23*b* of the reinforcing member 23 to thrust against the corresponding protrusions 26*b* of the fuser pad 26 without contacting the adjoining walls of the belt holder 60 where the fuser pad 26 bends under nip pressure during operation. This arrangement isolates the belt holder 60 from direct contact with the reinforcing member 23, and thus from pressure applied to the fuser pad 26 from the pressure roller 31, which would otherwise deform the thin-walled belt holder 60 from its generally cylindrical shape, leading to concomitant failures during operation.

The heater 25 comprises an elongated, radiant heating wire extending inside the tubular belt holder 60 in the axial direction X to radiate heat to an inner circumferential surface of the belt holder 60. The inner circumferential surface of the belt holder 60 may be coated with a black, thermally absorptive material to increase emissivity of the belt holder 60 for obtaining high thermal efficiency in heating the fuser belt 21 with the radiant heater 25. A thermometer may be disposed adjacent to the heater 25 to detect an operational temperature of the fuser belt 21 during operation.

Although in the embodiment described in FIG. 4, the heater 25 is configured as a radiant heater, which is ready to assemble and allows for an uncomplicated configuration of the fixing device 20, alternatively, instead, it is possible to configure the heater 25 as any heating element that can heat the belt holder 60 through radiation, conduction, induction, or any possible combination thereof.

For example, the heater 25 may be a laminated, planar heating element 25*a* extending inside and in contact with the tubular belt holder 60 in the axial direction X to conduct heat to an inner circumferential surface of the belt holder 60, as indicated by broken lines 25*a* in FIG. 4.

Figure 11:
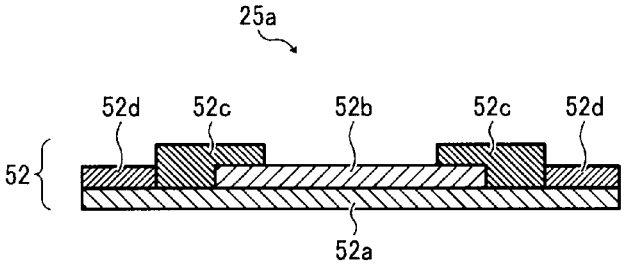
FIG. 11 is a cross-sectional view of a planar heating element for use in the fixing device of FIG. 4.

Specifically, with additional reference to FIG. 11, which is a cross-sectional view of an example of the planar resistive heater, the planar heating element 25*a* is shown including a laminated heat generator 52 formed of a resistive heating layer 52*b* of heat-resistant material with conductive particles dispersed therein, and an electrode layer 52*c* for supplying electricity to the resistive layer 52*b*, which are deposited adjacent to each other upon an electrically insulative substrate 52*a* to together form a heating circuit that generates heat for conduction to the belt holder 60. An insulation layer 52*d* is disposed to separate the resistive layer 52*b* from adjacent electrode layers of other heating circuits while isolating edges of the generator 52 from external components. A set of electrode terminals may also be provided at opposed longitudinal ends of the generator 52 to conduct electricity from wiring to the heating circuitry.

Using such a planar heating element instead of a radiant heater allows direct transmission of heat to the circumferential surface of the belt holder 60 to effectively heat the belt holder 60, leading to energy-efficient, fast fixing process with reduced warm-up time and first-print time required to process a print job.

Alternatively, instead, the heater 25 may be an induction heater with an inductor coil disposed inside or outside the tubular belt holder 60 in the axial direction X to generate heat in inner circumferential surface of the belt holder 60 through electromagnetic induction.

Using such an induction heater instead of a radiant heater allows for effective and reliable heating of the belt holder 60, in which the induction heating can selectively heat only those intended portions of the fuser assembly, i.e., the belt holder 60, while leaving the surrounding structure, such as the reinforcing member 23, unheated.

The mounting flange 28 comprises a flanged tubular piece of suitable material provided to a longitudinal end of the tubular belt holder 60 around which the fuser belt 21 is rotatably entrained, while retaining the longitudinal ends of the fuser pad 26, the inner retaining stay 70, the reinforcing member 23, and the heater 25 in their proper operational position, so as to form a single, integrated unit detachably attachable to the frame or sidewalls 42 of the fixing device 20 during mounting into the image forming apparatus 1.

Figure 12:
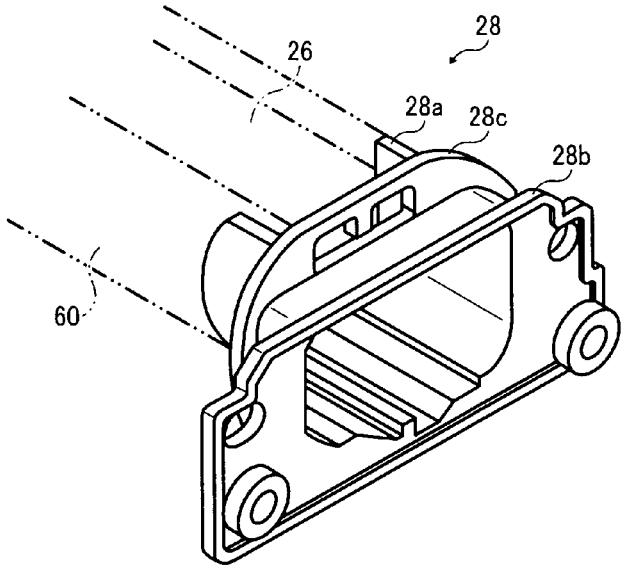
FIG. 12 is a perspective view of a mounting attachment during assembly with the belt holder and the fuser pad, included in the fixing device of FIG. 4.

With reference to FIG. 12, which is a perspective view of the mounting flange 28 during assembly with the belt holder 60 and the fuser pad 26, the mounting flange 28 is shown including a flanged portion 28*b* adapted to be affixed to the frame 42 and having its interior wall shaped to retain longitudinal ends of respective pieces of fuser assembly in position, and a tubular insert 28*a* extending from the flanged portion 28*b* to be inserted into the longitudinal end of the tubular belt holder 60. Also included is a collar 28*c* disposed around the insert 28*a* to contact the longitudinal end of the tubular belt holder 60 during assembly, and to restrict lateral displacement of the fuser belt 21 rotating around the belt holder 60 during operation.

The mounting flange 28 serves to maintain the belt holder 60 in shape at the longitudinal end of the metal holder 60, where the circumferential dimension of the thin-walled tubular body 60 is susceptible to variations due to production tolerances during manufacture and deformation upon sliding contact with the fuser belt during operation, which would detract from performance of the fixing device. For reliable retention of the belt holder 60, the tubular portion 28*a* of the mounting flange 28 has its outer circumferential dimension shaped in conformity with the inner circumferential dimension of the belt holder 60 with a clearance between the adjoining circumferential surfaces falling within approximately 0.15 mm or smaller.

The pressure roller 31 comprises a motor-driven, elastically biased cylindrical body formed of a hollowed core 32 of metal, covered with an intermediate layer 33 of elastic, thermally insulating material, such as silicone rubber or other solid rubber, approximately 2 mm to approximately 3 mm thick, and an outer layer 34 of release agent, such as a PFA layer formed into a tubular configuration, approximately 50 μm thick, deposited one upon another. The pressure roller 31 is equipped with a biasing mechanism that presses the cylindrical body against the fuser belt assembly, as well as a driving motor that imparts a rotational force or torque to rotate the cylindrical body. Optionally, the pressure roller 31 may have a dedicated heater, such as a halogen heater, accommodated in the hollow interior of the metal core 32.

With continued reference to FIG. 4, the belt holder 60 is shown with its circumferential dimensioned to provide a close, uniform contact between the fuser belt 21 and the belt holder 60 to effectively heat the belt 21 by conduction, while allowing for good separation of a recording sheet S from the belt holder 60 at the exit of the fixing nip N.

Specifically, as shown in FIG. 4, the tubular belt holder 60 includes, along a circumferential dimension thereof, an upstream, first circumferential portion P1 at which the belt holder 60 is subjected to heating by the heater 25 upstream from the fixing nip N, a downstream, second circumferential portion P2 at which the recording sheet S separates from the fuser belt 21 downstream from the fixing nip N, and a midstream, third circumferential portion P3 disposed upstream from the first circumferential portion P1 and downstream from the second circumferential portion P2, as well as an immediately upstream, fourth circumferential portion P4 disposed immediately upstream from the fixing nip N and downstream from the first circumferential portion P1, and a far downstream, fifth circumferential portion P5 disposed downstream from the second circumferential portion P2 and upstream from the third circumferential portion P3.

Figure 13:
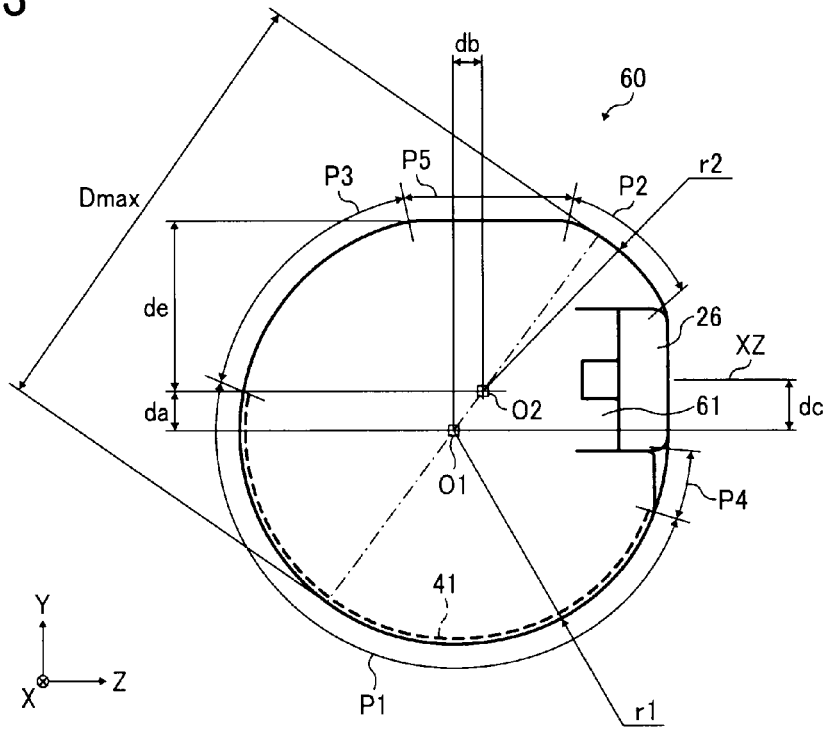
FIG. 13 is an end-on, axial view of the belt holder assembled with the fuser pad, shown with other surrounding components omitted.

FIG. 13 is an end-on, axial view of the belt holder 60 assembled with the fuser pad 26, shown with other surrounding components omitted, for illustrating in greater detail the circumferential configuration of the belt holder 60.

As shown in FIG. 13, in the belt holder 60, the first circumferential portion P1 defines a first arc-shaped cross-section whose outer radius r1 is approximately equal to or smaller than an inner radius of the fuser belt 21 in the generally cylindrical configuration thereof, and whose center O1 is displaced, in the conveyance direction Y, away from a reference plane XZ containing the central axis of the fuser pad 26 and extending perpendicular to the conveyance direction Y. The second circumferential portion P2 defines a second arc-shaped cross-section whose outer radius r2 is dimensioned relative to the outer radius r1 of the first circumferential portion P1, and whose center O2 is displaced away from the center O1 of the first circumferential portion P1 toward the fixing nip N by a distance da in the conveyance direction Y and by a distance db in the load direction Z.

More specifically, a maximum diameter Dmax of the belt holder 60, as defined by a maximum distance between the outer surfaces of the first circumferential portion P1 and the second circumferential portion P2 (i.e., the length of a longest imaginary straight line connecting the outer circumferential surface of the first portion P1 to that of the second portion P2), is larger than the inner diameter, or twice the inner radius, of the fuser belt 21 in the generally cylindrical configuration thereof.

For example, where the inner radius of the fuser belt 21 is approximately 15 mm, the outer radius r1 of the first circumferential portion P1 may be approximately 14.5 mm, with a distance dc between the center O1 of the first circumferential portion P1 and the reference plane XZ being approximately 3.4 mm. In such cases, the outer radius r2 of the second circumferential portion P2 may be approximately 13 mm, the distance da between the centers of the first and second circumferential portions P1 and P2 in the conveyance direction Y be approximately 2.7 mm, and the distance db between the centers O1 and O2 of the first and second circumferential portions P1 and P2 in the load direction Z be approximately 2 mm, yielding a belt holder maximum diameter Dmax of approximately 30.86 mm, which is larger than the inner diameter (i.e., approximately 30 mm) of the fuser belt 21.

As used herein, the terms "upstream", "downstream", and "midstream", when used in connection with the circumferential portions of the belt holder 60, refer to positions relative to the fixing nip N in the circumferential, rotational direction C of the fuser belt 21, so that the fuser belt 21, during one rotation around the belt holder 60, first enters the nip N from the upstream portion, exits the nip N to enter the downstream portion, then proceeds to the midstream portion to again reach the upstream portion. The term "reference plane XZ" refers to an imaginary plane containing the central axis of the fuser pad 26 and extending perpendicular to the conveyance direction Y as set forth herein, which can be used as a reference for determining relative positions of points, lines, and areas, in particular, the centers or central axes of the circumferential portions, of the belt holder 60 in cross-section of the fuser assembly.

Also, dimensions of a fixing member formed of elastic or flexible material are defined as those measured where such a flexible fixing member retains its original, designed shape before assembly into the fixing device. Thus, the inner radius of the fuser belt 21 is defined as a length of a straight line segment that joins the central axis of the tubular body with any point on its inner circumferential surface, measured where the fuser belt 21 retains its generally cylindrical configuration before assembly with the belt holder 60. The inner diameter of the fuser belt 21 may be obtained accordingly from the inner radius as set forth herein.

In such a configuration, the tubular belt holder 60 can maintain tension on the fuser belt 21 entrained therearound owing to the first circumferential portion P1 having its outer radius r1 approximately equal to the inner radius R of the fuser belt 21, and its center O1 displaced, in the conveyance direction Y, away from the reference plane XZ. The flexible fuser belt 21, thus entrained under tension, stretches from the upstream, first circumferential portion P1 toward the fixing nip N during rotation around the belt holder 60, so as to establish a close, uniform contact with the belt holder 60 with substantially no spacing left between the adjoining surfaces of the belt 21 and the belt holder 60.

Also, designing the belt holder 60 with substantial equality between the outer and inner radii of the first circumferential portion P1 and the fuser belt 21 prevents undue stress and concomitant deformation on the fuser belt 21, so that the belt 21 can maintain its original, generally cylindrical configuration to more closely and uniformly contact the belt holder 60 along the first circumferential portion P1. For proper movement of the fuser belt 21 around the belt holder 60, the outer radius r1 of the first circumferential portion P1 is smaller than the inner radius of the fuser belt 21 by a difference not exceeding approximately 2 millimeters.

Further, dimensioning the belt holder 60 with its maximum diameter Dmax greater than the inner diameter of the fuser belt 21 causes the fuser belt 21 to stretch across the opposed circumferential portions P1 and P2, so as to more closely and uniformly contact the belt holder 60 along the first circumferential portion P1 with effectively reduced spacing between the adjoining surfaces of the belt 21 and the belt holder 60.

Hence, the fixing device 20 according to this patent specification provides a thermally efficient, reliable fixing process owing to the special configuration of the belt holder 60, wherein maintaining a close, uniform contact between the fuser belt 21 and the belt holder 60 along the upstream circumferential portion P1 at which the belt holder 60 is subjected to heating allows for efficient thermal conduction between the belt holder 60 and the fuser belt 21, leading to a thermally efficient fixing process with a reduced warm-up time and first-print time, while preventing the belt holder 60 from overheating where the fuser belt 21 is heated without rotation (e.g., upon start-up), which would otherwise cause premature deterioration of the coating layers 21*a* and 60*a* on the belt and holder circumferential surfaces.

In further embodiment, the outer radius r2 of the second circumferential portion P2, which is suitably dimensioned with respect to the outer radius r1 of the first circumferential portion P1, may be smaller than the outer radius r1 of the first circumferential portion P1, so that the belt holder 60 exhibits a greater curvature at the downstream portion P2 than at the upstream portion P1 along its circumferential dimension.

Such arrangement allows for reliable conveyance of recording sheets S downstream from the fixing nip N, where the fuser belt 20 moving along the increased curvature of the circumferential portion P2 can immediately separate from the recording sheet S, which then proceeds properly without adhering to the fuser belt 21 at the exit of the fixing nip N.

Further, the third circumferential portion P3 of the belt holder 60 defines a third, arc-shaped cross-section whose radius r3 is approximately equal to the outer radius r1 of the first circumferential portion P1, and whose center is positioned coextensive with the center O1 of the first circumferential portion P1.

Such arrangement allows for efficient, cost-effective production of the belt holder 60, where the adjoining circumferential portions of the metal-worked tubular body, having identical curvatures, are more ready to process than those having different, irregular curvatures.

Alternatively, instead of configuring the first and third circumferential portions P1 and P3 equidistant from their common center point O1, the arc-shaped cross-section of the third circumferential portion P3 may be located closer to the center O1 of the first circumferential portion P1 than is the first arc-shaped cross-section of the first circumferential portion P1, insofar as the third circumferential portion P3 does not interfere with the reinforcing member 23 inside the belt holder 60.

Such arrangement allows for reliable conveyance of recording sheets S through the fixing nip N, wherein the belt holder 60 does not contact the fuser belt 21 at the third circumferential portion P3, so that the friction between the belt 21 and the holder 60 is smaller than that between the belt 21 and the recording sheet S, which prevents the incoming sheet S from incidentally slipping off the belt surface at the fixing nip N. Also, designing the third circumferential portion P3 with a smaller dimension results in a reduced amount of material and cost required for producing the tubular belt holder 60.

Still further, the fourth circumferential portion P4 of the belt holder 60 defines a fourth, generally flattened cross-section located closer to the center O1 of the first circumferential portion P1 than is the first arc-shaped cross-section of the first circumferential portion P1. The fourth circumferential portion P4 thus has a smaller curvature than that of the first circumferential portion P1, which connects the first circumferential portion P1 to the side slot 61 of the belt holder 60.

Such arrangement prevents the fuser belt 21 from elevating away from the belt holder 60 immediately upstream from the fixing nip N, thereby ensuring that the belt 21 properly enters the fixing nip N and introduces the recording sheet S along its outer circumferential surface.

Yet still further, the fifth circumferential portion P5 of the belt holder 60 defines a fifth, generally flattened cross-section along which the fuser belt 21 during rotation is movable away from contact with the belt holder 60. The fifth circumferential portion P5 is at a distance de, shorter than the inner radius of the fuser belt 21, away from the center O2 of the second circumferential portion P2. For example, where the fuser belt 21 has an inner radius of approximately 15 mm in its generally cylindrical configuration, the distance de between the fifth circumferential portion P5 and the center O2 of the second circumferential portion P2 is approximately 11.5 mm in the conveyance direction Y.

Such arrangement prevents undue friction between the fuser belt 21 and the belt holder 60 far downstream from the fixing nip N, at which a close contact between the adjoining surfaces of the belt 21 and the holder 60 is no longer necessary, unlike the case for the first circumferential portion P1 conducting heat to the fuser belt 21 upstream from the fixing nip N.

Still further, the belt holder 60 may have its inner circumferential surface, in particular, that of the first circumferential portion P1, coated with a black, absorptive material 41.

Such arrangement causes the belt holder 60 to exhibit high emissivity when subjected to radiation, allowing for high thermal efficiency in heating the fuser belt 21 by radiating the belt holder 60 with the radiant heater 25.

Yet still further, the belt holder 60 and the fuser pad 26 may together form an assembled cylindrical structure that has a closed, outer circumference La smaller than an inner circumference Lb of the fuser belt 60 in the generally cylindrical configuration thereof, with a difference Lb−La between the outer circumference of the assembled cylindrical structure and the inner circumference of the fuser belt 21 being within a range from approximately 0.5 mm to approximately 0.9 mm, preferably, within a range from approximately 0.6 mm to approximately 0.8 mm, and more preferably, equal to approximately 0.7 mm.

Too long a differential length Lb−La causes an excessive slack in the fuser belt 21 around the belt holder 60, resulting in overheating of the belt holder 60 due to a loss of contact between the belt 21 and the belt holder 60, which would adversely affect durability of the coating layer 60*a* on the outer circumferential surface of the belt holder 60. Contrarily, too short a differential length Lb−La translates into an excessive tension on the fuser belt 21 around the belt holder 60, resulting in an excessive frictional resistance between the fuser belt 21 and the belt holder 60, which would not only affect proper rotation of the fuser belt 21, but also induce slippage of the pressure roller 31 and the recording sheet S with respect to the moving fuser belt 21 at the fixing nip N.

Thus, maintaining the differential length Lb−La within a moderate, appropriate range prevents failures of the fixing device caused by excessive slack or tension in the fuser belt 21 entrained around the belt holder 60. The differential length Lb−La between the adjoining surfaces of the pad/holder assembly and the fuser belt 21 may be determined where at least one of the outer circumferential surface of the belt holder 60 and the inner circumferential surface of the fuser belt 12 is provided with a coating layer, and where the fixing device 20 includes a lubricant deposited between the outer circumferential surface of the belt holder 60 and the inner circumferential surface of the fuser belt 21.

Although the fuser assembly in the present embodiment is depicted with specific ranges for the differential length Lb−La, the appropriate range for the differential length Lb−La may be other than those described herein depending on specific configurations, with consideration given to the thicknesses of the coating layers 21*a* and 60*a* and the lubricant agent 40, as well as the shape and dimensions of the respective components of the fuser assembly.

Experiments have been conducted to evaluate effects of the differential length Lb−La between the circumferences of the fuser belt 21 and the belt holder 60 on the performance of the fixing device 20, in which an operational temperature T at the surface of the belt holder 60 and a friction F between the adjoining surfaces of the fuse belt 21 and the belt holder 60 were measured with varying differential lengths Lb−La in a fixing device similar to that depicted above primarily with reference to FIG. 4.

Figure 14:
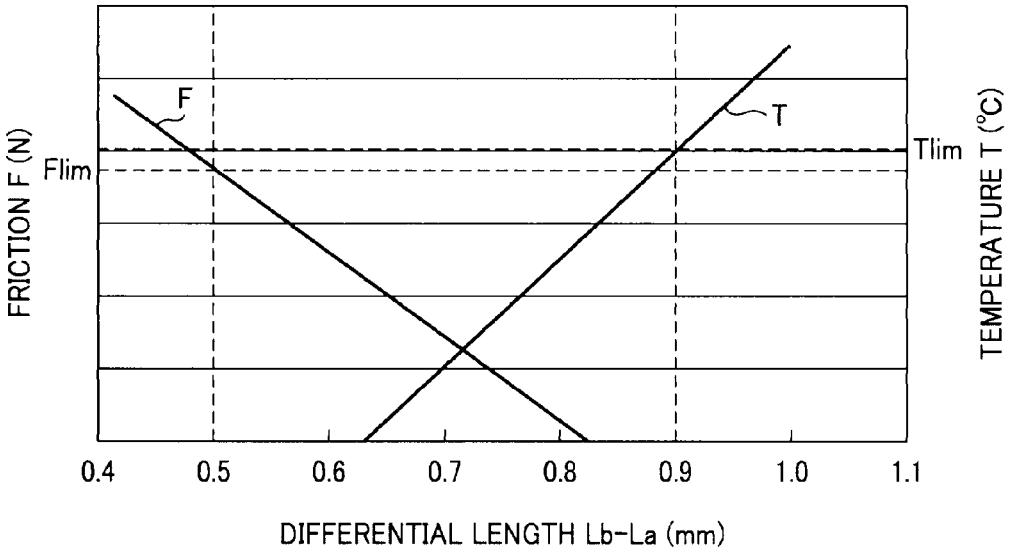
FIG. 14 shows graphs of measurements of operational temperature, in degrees Celsius, and friction, in newtons, between belt and holder circumferential surfaces obtained through experiments, each plotted against a differential length, in millimeters.

Results of such experiments are shown in FIG. 14, which provides measurements of the operational temperature T, in degrees Celsius (° C.), and the friction F, in newtons (N), between the belt and holder circumferential surfaces, each plotted against the differential length Lb−La, in millimeters (mm).

As shown in FIG. 14, the operational temperature T increases as the differential length Lb−La increases, whereas the friction F increases as the differential length Lb−La decreases. The rise in the operational temperature T is attributable to the fact that increasing the differential length Lb−La causes an increased slack in the fuser belt 21, resulting in a partial loss of contact between the belt 21 and the belt holder 60 and concomitant local, intensive heating in the fuser belt 21 around the belt holder 60. On the other hand, the rise in the friction F is attributable to the fact that decreasing the differential length Lb−La causes an increased tension in the fuser belt 21, which thus experiences an increased frictional resistance during rotation around the belt holder 60.

Specifically, at a differential length Lb−La of approximately 0.9 mm, the operational temperature T exceeds a maximum allowable temperature limit Tlim, to which the belt holder 60 can be heated without significantly damaging the coating layer 60*a*. That is, increasing the differential length Lb−La over approximately 0.9 mm causes the operational temperature T to exceed the maximum allowable limit Tlim, which would adversely affect durability of the coating layer 60*a* on the outer circumferential surface of the belt holder 60.

At a differential length Lb−La of approximately 0.5 mm, the friction F exceeds a maximum allowable friction limit Flim with which the fuser belt 21 can properly rotate around the belt holder 60 without causing slippage of the pressure roller 31 and the recording sheet S against the rotating belt 21. That is, decreasing the differential length Lb−La below approximately 0.5 mm causes the friction F to exceed the maximum allowable limit Flim, which would not only affect proper rotation of the fuser belt 21, but also induce slippage of the pressure roller 31 and the recording sheet S with respect to the moving fuser belt 21 at the fixing nip N.

The experimental results above demonstrate that setting the differential length Lb−La in the range of approximately 0.5 mm to approximately 0.9 mm is effective in preventing damage to the coating layer 60*a* due to overheating, and providing proper rotation of the fuser belt 21 without slippage of the pressure roller 31 and the recording sheet S. More effective fixing performance can be obtained by keeping the differential length Lb−La in the range of approximately 0.6 mm to approximately 0.8 mm, preferably, approximately 0.7 mm.

As mentioned earlier, the fixing device 20 according to this patent specification employs the fuser pad 26 accommodated in the belt holder 60 inside the loop of the fuser belt 21, and extending in the axial direction X of the belt holder 60, so as to establish the fixing nip N where the pressure roller 31 presses against the fuser pad 26 through the fuser belt 21. Such a fuser pad 26 is equipped with the anti-friction cover 29 to lubricate where the fuser pad 26, positioned stationary within the fixing assembly, remains in continuous sliding contact with the inner circumferential surface of the rotating belt 21 during operation.

The inventors have recognized several problems encountered when providing a fuser pad with anti-friction covering in a conventional fixing device.

One problem is the difficulty in fastening the anti-friction cover in position around the fuser pad, so that the anti-friction cover on the front side of the fuser pad establishes a proper, slidable contact with the inner surface of the fuser belt, while ensuring the protrusions on the rear side of the fuser pad contact the reinforcing member properly and stably. This is particularly true where provision of the multiple protrusions for contacting the reinforcing member leaves only a limited space for deploying the fasteners on the rear side of the fuser pad.

Another problem is that wrapping the anti-friction cover around the fuser pad held against the rigid, reinforcing member to support the pad against pressure from the pressure member causes misalignment of the fuser pad within the fuser assembly due to variations in thickness of the cover material interposed between the fuser pad and the reinforcing member.

Misalignment of the fuser pad result in a lack of uniformity in width and strength of the fixing nip being established, leading eventually to defects in a resultant image processed through the fixing device.

To overcome these and other problems, the fixing device 20 according to this patent specification is specially configured to allow ready fastening of the anti-friction cover and precise positioning of the fuser pad within the fuser assembly, leading to good imaging performance with uniform width and strength of the fixing nip N defined along the fuser pad. A detailed description is now given of such special configuration of the fixing device 20, with reference to FIGS. 15A and 15B and subsequent drawings.

Figure 15A:
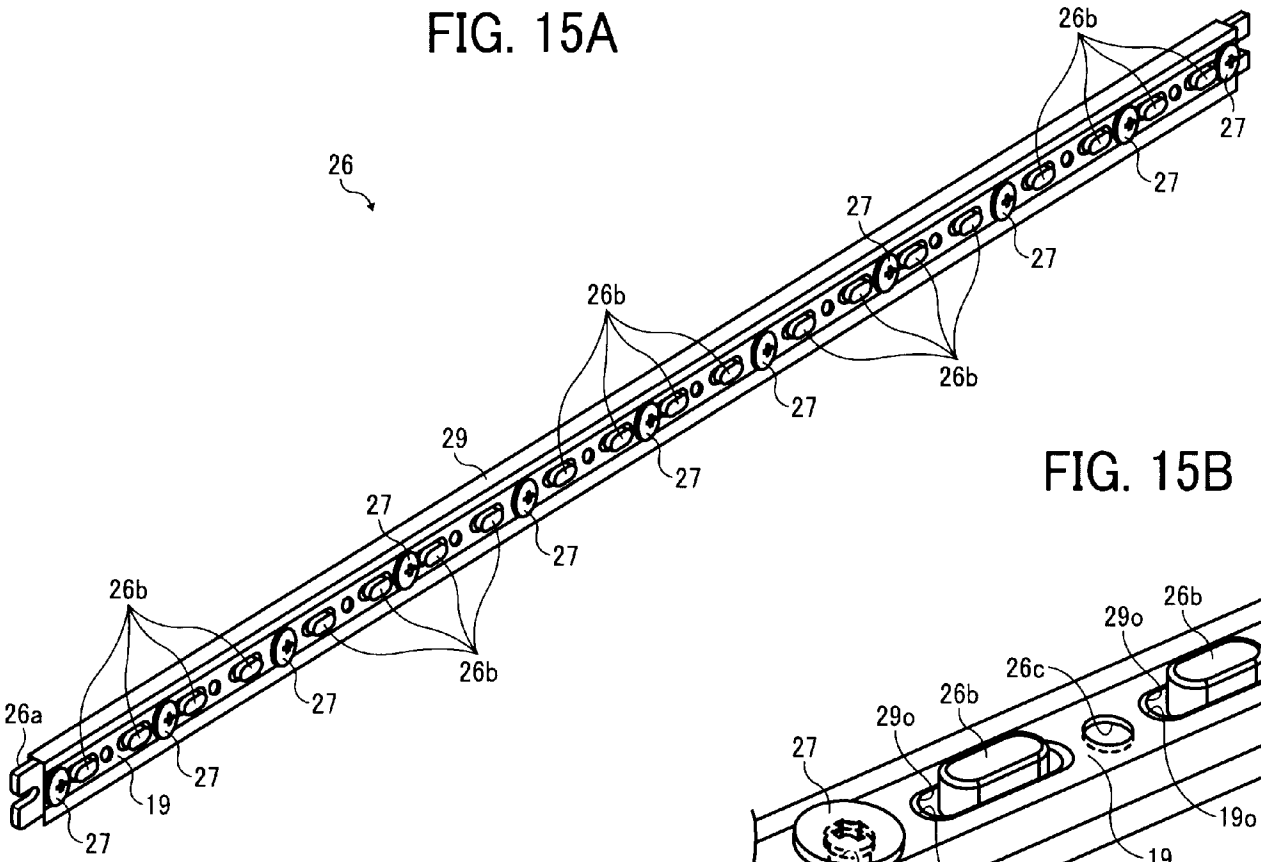
FIGS. 15A and 15B are perspective and enlarged partial perspective views, respectively, of the fuser pad included in the fixing device according to one or more embodiments of this patent specification.
Figure 15B:
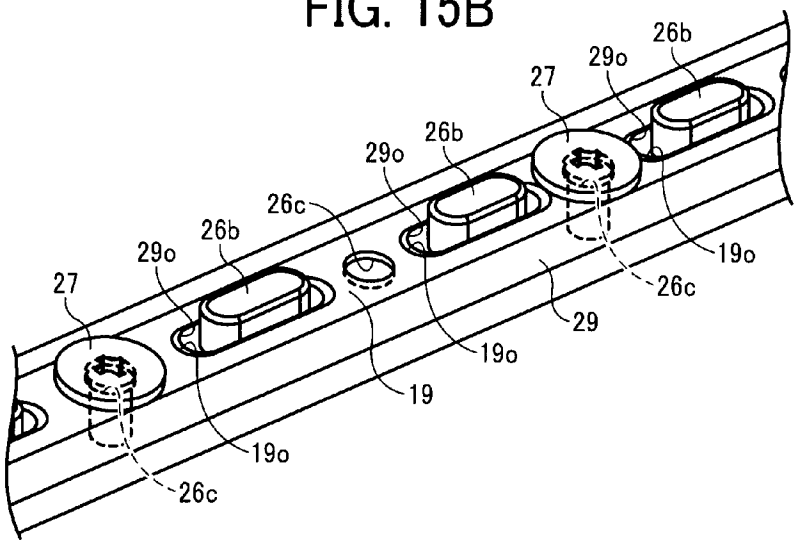

FIGS. 15A and 15B are perspective and enlarged partial perspective views, respectively, of the fuser pad 26 included in the fixing device 20 according to one or more embodiments of this patent specification.

As shown in FIGS. 15A and 15B, the fuser pad 26 includes an elongated base 26*a* defining a smooth surface on a front side thereof (not visible in the view shown) for facing the pressure roller 31 and multiple longitudinally spaced protrusions 26*b* on a rear side opposite the front side thereof for contacting the reinforcing member 23. A perforated, anti-friction cover 29 is disposed around the elongated base 26*a* to reduce friction between the fuser pad 26 and the fuser belt 21. The cover 29 has one or more openings 29*o* therein for inserting therethrough the protrusions 26*b* on the rear side of the elongated base 26*a*. A fastener 27 is disposed between adjacent protrusions 26*b* on the rear side of the elongated base 26*a* to fasten the cover 29 in position around the elongated base 26*a*. The fuser pad 26 may also have an optional, perforated elongated attachment 19 that has one or more openings 19*o* therein for inserting therethrough the protrusions 26*b*, while fastened together with the cover 29 on the rear side of the elongated base 26*a*.

Specifically, in the present embodiment, the multiple protrusions 26*b* of the fuser pad 26 are arranged and spaced apart from each other in the axial direction X, each extending from the rear side of the elongated base 26*a* to define an oval-shaped contact surface that contacts an associated one of the protrusions 23*b* provided on the reinforcing member 23 in the assembled fixing device.

The anti-friction cover 29 comprises a wrappable sheet of suitable lubricant material, such as a web of PTFE fibers, having multiple oval openings 29*o* defined therein, the number of which is equal to that of the protrusions 26*b*, and each of which is shaped and dimensioned to engage an associated one of the protrusions 26*b* as the cover 29 is wrapped around the elongated base 26*a*.

The fastener 27 comprises a set of screws inserted into screw holes 26*c* of the elongated base 26*a* through screw holes of the cover 29 and the attachment 19, so as to fasten together the cover 29 and the attachment 19 in position on the rear side of the elongated base 26*a*. The fastening screws 27 are dimensioned so that their screw heads do not extend beyond the contact surfaces of the protrusions 26*b* on the rear side of the elongated base 26*a* in the complete fuser assembly.

The number of screws 27 for fastening the cover 29 may be smaller than that of screw holes 26*c* provided in the elongated base 26*b*, in which case the screws 27 are accommodated in selected ones of the screw holes 26*c*, spaced evenly or symmetrically with respect to each other to provide balanced fastening along the elongated base 26*a*. For example, where fastening is accomplished with eleven screws 27 and twenty-one screw holes 26*c*, as in the present embodiment, the screws 27 are disposed in every other screw holes 26*c*, including those at the longitudinal ends of the elongated base 26*a*.

Figure 16A:
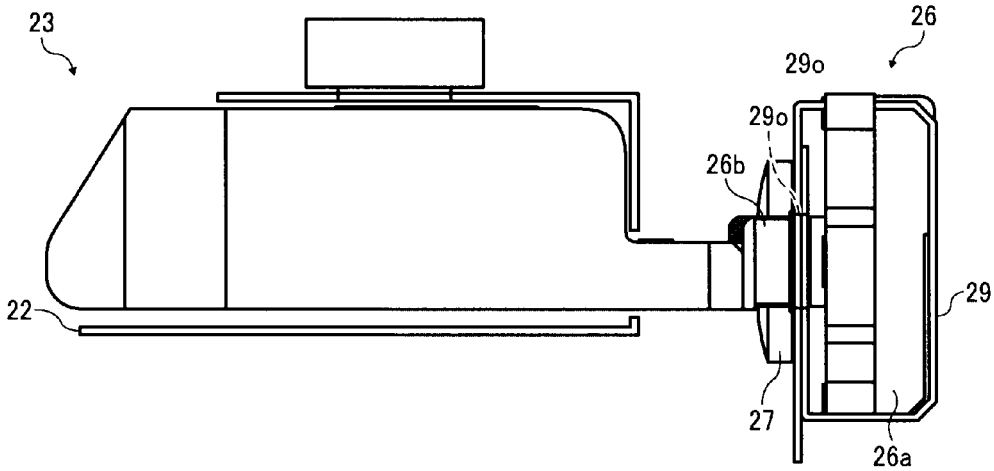
FIGS. 16A and 16B are side and partial top views, respectively, of the fuser pad of FIGS. 15A and 15B assembled with the reinforcing member.
Figure 16B:
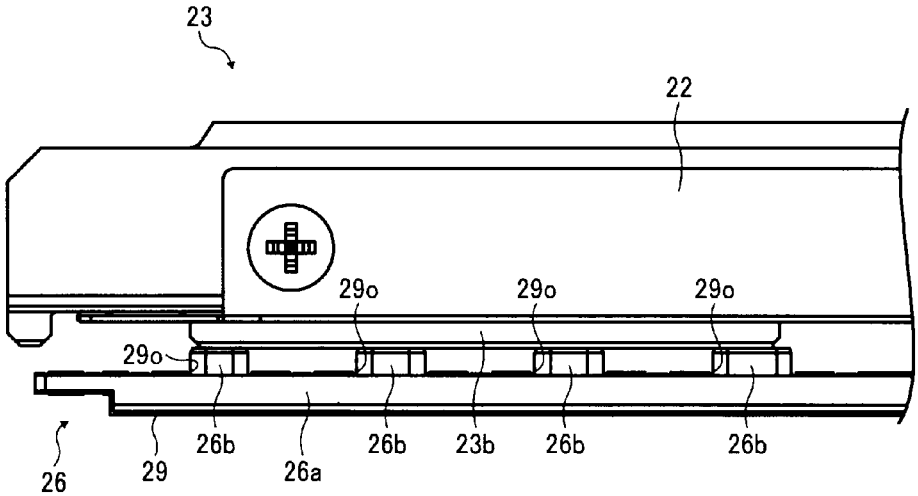

FIGS. 16A and 16B are side and partial top views, respectively, of the fuser pad 26 assembled with the reinforcing member 23.

As shown in FIGS. 16A and 16B, provision of the perforated anti-friction cover 29 exposes the protrusions 26*b* of the fuser pad 26 outward via the openings 29*o* to contact the protrusions 23*b* of the reinforcing member 23 directly without interposition of the covering material. Direct contact thus established between the contact portions of the fuser pad 26 and the reinforcing member 23 allows for precise positioning of the fuser pad 26 held against the reinforcing member 23 within the fuser assembly, leading to good imaging performance with uniform width and strength of the fixing nip N in the fixing device 20.

In addition, providing the multiple longitudinally spaced protrusions 26*b*, compared to a single, longitudinally extending protrusion, along the length of the elongated base 26*a* leaves a sufficient space for deploying the fasteners 27 adjoining the protrusions 26*b* on the rear side of the elongated base 26*a*. Such arrangement facilitates fastening of the anti-friction cover 29 in position around the fuser pad 26, so that the cover 29 on the front side of the fuser pad 26 establishes a proper, slidable contact with the inner surface of the fuser belt 21, while ensuring the protrusions 26*b* on the rear side of the fuser pad 26 contact the reinforcing member 23 properly and stably in the assembled fixing device 20.

Although in the present embodiment the fuser assembly is shown with the reinforcing member 23 having five protrusion 23*b* each of which contacts four protrusion 26*b* of the fuser pad 26, the number of protrusions provided on the reinforcing member 23 and the fuser pad 26 may be other than that depicted in the drawings. Where the number of protrusions 23*b* on the reinforcing member 23 is different from that on the fuser pad 26, each protrusion 23*b* of the reinforcing member 23 contacts more than one protrusion 26*b* of the fuser pad 26 or vice versa.

Figure 17:
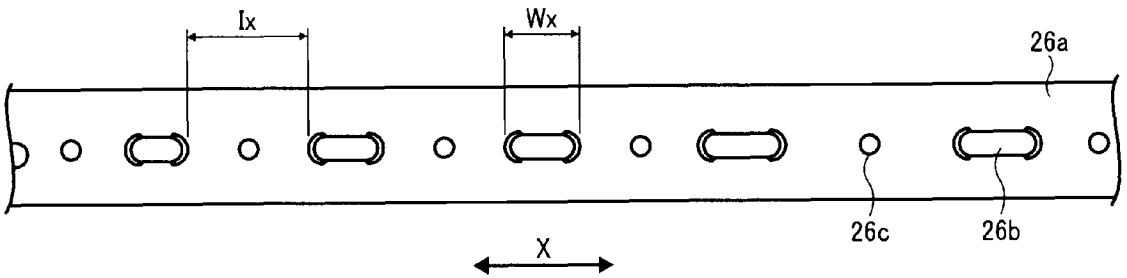
FIG. 17 is a partial rear view of an elongated base with an anti-friction cover and a fastener of the fuser pad of FIGS. 15A and 15B.

FIG. 17 is a partial rear view of the elongated base 26*a* before assembly with the anti-friction cover 29 and the fastener 27 of the fuser pad 26.

As shown in FIG. 17, on the rear side of the elongated base 26*a*, the protrusions 26*b* are arranged spaced at a variable spacing or interval Ix from each other in the axial direction X, each defining an oval-shaped contact surface with a variable width Wx in the axial direction X, with the screw holes 26*c* each being interposed between two adjoining protrusions 26*b* for deploying the fasteners 27 therebetween.

Specifically, the width Wx of the contact surfaces of the protrusions 26*b* falls within a range between approximately 5 mm and approximately 7 mm, and the interval Ix between two adjoining protrusions 26*b* falls within a range between approximately 6 mm and approximately 14 mm. In the present embodiment, for example, these dimensions Wx and Ix for the respective protrusions 26*b* increase with their relative position in the axial direction X, so that of the five protrusions 26*b* shown from left to right in FIG. 17, the first one measures 5 mm, the second and third 6 mm, and the fourth and fifth 7 mm in width Wx of their contact surfaces, with the interval Ix between the first and second protrusions being smaller than that between the fourth and fifth protrusions.

Setting the interval Ix between the adjoining protrusions 26*b* within the appropriate range described above allows for proper fastening of the cover 29 to the fuser pad 26, while ensuring the fuser pad 26 establishes a proper, uniform pressure across the fixing nip N. That is, spacing the protrusions 26 at an interval shorter than 6 mm results in a lack of appropriate space for deploying the fasteners therebetween, which leads to weak, insufficient fastening of the cover 29 to the elongated base 26*a*. On the other hand, spacing the protrusions 26 at an interval longer than 14 mm results in a periodic, localized reduction in pressure across the fixing nip N, where the entire length of the fuser pad 26 is not fully supported by the reinforcing member 23 in the axial direction X, leading to unstable fixing performance as well as creation of undesired wrinkles or creases on a resulting print conveyed through the fixing nip N.

Figure 18A:
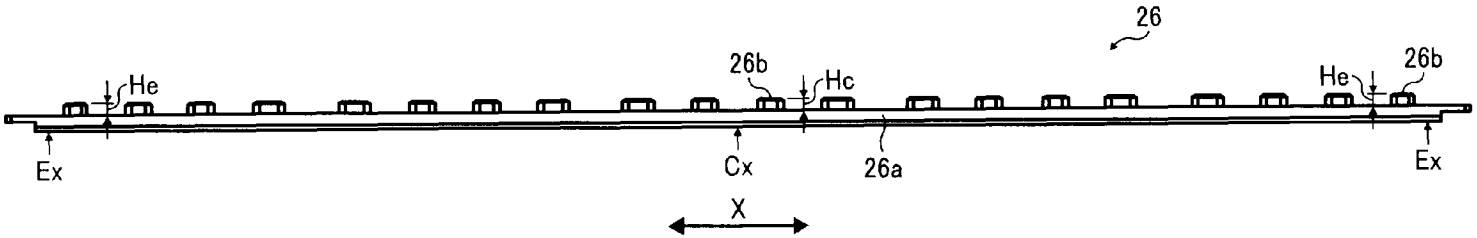
FIG. 18A is an elevational view of the elongated base with an anti-friction cover and a fastener of the fuser pad of FIGS. 15A and 15B.
Figure 18B:
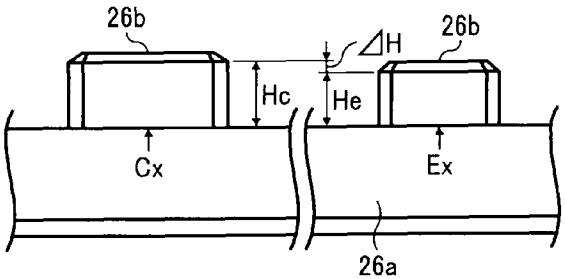
FIG. 18B is a partial enlarged view of the elongated base of FIG. 18A.

FIG. 18A is an elevational view of the elongated base 26*a* before assembly with the anti-friction cover 29 and the fastener 27 of the fuser pad 26, and FIG. 18B is a partial enlarged view of the elongated base 26*a* of FIG. 18A.

As shown in FIG. 18A, the multiple protrusions 26*b* of the fuser pad 26 are dimensioned with different height H in the load direction Z in which the fuser pad 26 is pressed against by the pressure roller 31.

Specifically, the heights H of the protrusions 26*b* in the load direction Z decrease with increasing distance from a longitudinal center Cx of the elongated base 26*a* and decreasing distance thereof from a longitudinal end Ex of the elongated base 26*a*. That is, in the axial direction X from the longitudinal center Cx to each longitudinal end Ex of the elongated base 26*a*, the height H of protrusion gradually decreases from a maximum Hc to a minimum He, yielding a certain difference ΔH between the heights Hc and He of the central and peripheral protrusions 26*b* of the fuser pad 26, as shown in FIG. 18B.

More specifically, the difference in height ΔH between the central and peripheral protrusions 26*b* at the longitudinal center Cx and the longitudinal end Ex, respectively, of the elongated base 26*a* substantially equals an amount of deformation by which the reinforcing member 23 bends under pressure from the pressure member 31. For example, such a height difference ΔH may fall within a range between approximately 0.3 mm and approximately 0.48 mm, preferably between approximately 0.375 mm and approximately 0.425 mm.

Thus, should the reinforcing member 23 subjected to nip pressure bend away from the pressure roller 31 during operation, such deformation of the reinforcing member 23 is accommodated by the height differential ΔH between the longitudinal center and end of the fuser pad 26. Such arrangement effectively prevents a local reduction in width and pressure around the longitudinal center of the fixing nip N, allowing for good, stable imaging performance with uniform width and strength across the entire fixing nip N in the fixing device 20.

Experiments have been conducted to investigate effects of the difference in height ΔH between the central and peripheral protrusions 26*b* of the fuser pad 26 on performance of the fixing device, in which two types of fuser pads were prepared with varying difference in height ΔH between the central and peripheral protrusions: Sample A with a height difference ΔH of 0.4 mm, and Sample B with a height difference ΔH of 0.5 mm. Each sample was combined with two types of elastic pressure rollers with varying hardness, measured in Shore hardness (HS) of rubber forming the elastic layer, to obtain a fixing assembly which was then installed with a suitable biasing mechanism to form a fixing nip N with a length of 300 mm in the axial direction X and a total load of 240 newtons (N) applied in the load direction Z. Measurements were carried out to determine a width of the fixing nip N in the conveyance direction Y and an average nip pressure (i.e., pressure per unit area within the fixing nip N) at the longitudinal center and the longitudinal end of the fuser pad.

Figure 19A:
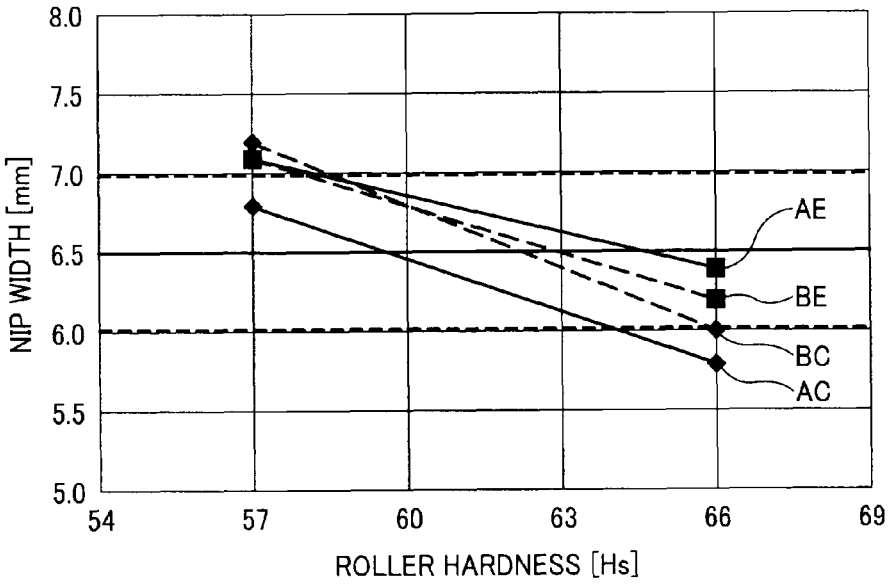
FIGS. 19A and 19B are graphs showing experimental results, the former plotting a nip width, in mm, against the hardness, in HS, of a pressure member, and the latter plotting an average nip pressure, in kgf/cm$^2$, against the hardness, in HS, of a pressure roller.
Figure 19B:
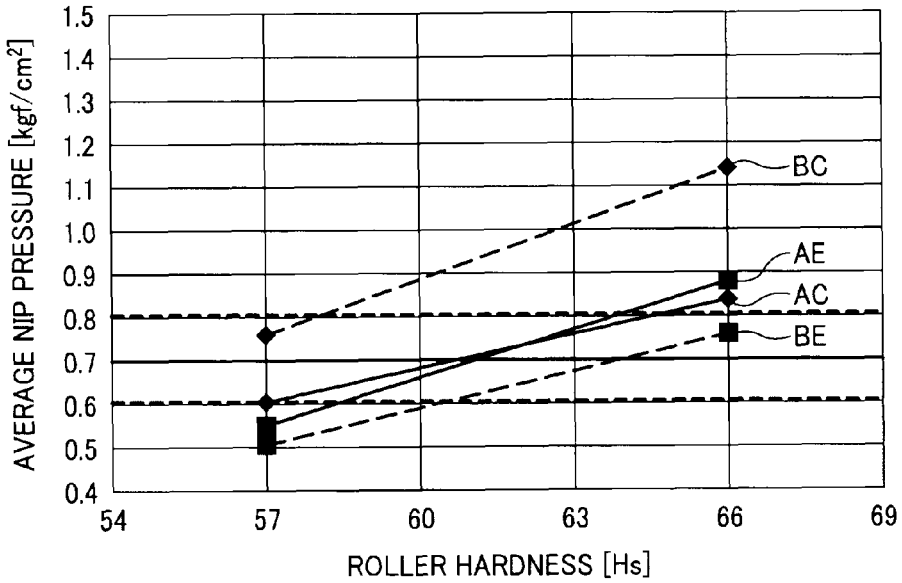

FIGS. 19A and 19B are graphs showing results of the experiments, the former plotting the nip width, in mm, against the hardness, in HS, of the pressure roller, and the latter plotting the average nip pressure, in $kgf/cm^2$, against the hardness, in HS, of the pressure roller. As shown in FIGS. 19A and 19B, as the hardness of the pressure roller increases from 57 HS to 66 HS, the nip width measured at the different locations of both samples generally decreases whereas the average nip pressure measured at the different locations of both samples generally increases.

With specific reference to FIG. 19A, in Sample A, the nip width measured at the longitudinal end (solid line labeled "AE") is slightly above 7 mm at the roller hardness of 57 HS and slightly below 6.5 mm at the roller hardness of 66 HS, whereas the nip width measured at the longitudinal center (solid line labeled "AC") is between 6.5 mm and 7 mm at the roller hardness of 57 HS and slightly below 6 mm at the roller hardness of 66 HS. In Sample B, on the other hand, the nip width measured at the longitudinal end (broken line labeled "BE") is slightly above 7 mm at the roller hardness of 57 HS and between 6 mm and 6.5 mm at the roller hardness of 66 HS, whereas the nip width measured at the longitudinal center (broken line labeled "BC") is slightly above 7 mm at the roller hardness of 57 HS and approximately 6 mm at the roller hardness of 66 HS.

Thus, with the specific range of roller hardness employed in the experiments, both samples prepared exhibited a nip width between 6 mm and 7 mm constantly and simultaneously at the longitudinal end and the longitudinal center of the fuser pad, which substantially encompasses an allowable range for the nip width to obtain good imaging performance in the fixing device.

With specific reference to FIG. 19B, in Sample A, the average nip pressure measured at the longitudinal end (solid line labeled "AE") is slightly below 0.6 kgf/cm$^2$ at the roller hardness of 57 HS and between 0.8 and 0.9 kgf/cm$^2$ at the roller hardness of 66 HS, whereas the average nip pressure measured at the longitudinal center (solid line labeled "AC") is approximately 0.6 kgf/cm$^2$ at the roller hardness of 57 HS and slightly above 0.8 kgf/cm$^2$ at the roller hardness of 66 HS. In Sample B, on the other hand, the average nip pressure measured at the longitudinal end (broken line labeled "BE") is approximately 0.5 kgf/cm$^2$ at the roller hardness of 57 HS and between 0.7 and 0.8 kgf/cm$^2$ at the roller hardness of 66 HS, whereas the average nip pressure measured at the longitudinal center (broken line labeled "BC") is between 0.7 and 0.8 kgf/cm$^2$ at the roller hardness of 57 HS and between 1.1 and 1.2 kgf/cm$^2$ at the roller hardness of 66 HS.

Thus, with the specific range of roller hardness employed in the experiments, Sample A exhibited an average nip pressure of between 0.6 and 0.8 kgf/cm$^2$ constantly and simultaneously at both the longitudinal end and the longitudinal center of the fuser pad, which substantially encompasses an allowable range for the average nip pressure to obtain good imaging performance in the fixing device. Contrarily, throughout the experimental conditions, Sample B never exhibited an allowable average nip pressure constantly and simultaneously at both the longitudinal end and the longitudinal center of the fuser pad Accordingly, dimensioning the central and peripheral protrusions with a difference in height ΔH of 0.4 mm enables the fuser pad to consistently establish a fixing nip with a proper, uniform width and average pressure throughout the length of the fuser assembly. By contrast, dimensioning the central and peripheral protrusions with a difference in height ΔH of 0.5 mm, although effective in obtaining a uniform nip width, does not allow a uniform average pressure to be created throughout the length of the fuser assembly. The experimental results above demonstrate that setting the height difference ΔH within an appropriate range as defined in the present embodiment allows for good fixing performance as it compensates for possible deformation of the reinforcing member under nip pressure more effectively and reliably than would otherwise be possible.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a tubular belt holder;

a rotatable, flexible fuser belt looped for rotation around the belt holder;

a heater disposed adjacent to the belt holder to heat the belt holder to in turn heat the fuser belt;

a fuser pad accommodated in the belt holder inside the loop of the fuser belt, and extending in an axial direction of the belt holder;

a rotatably driven pressure member disposed opposite the belt holder, with the fuser belt interposed between the fuser pad and the pressure member, the pressure member pressing in a load direction against the fuser pad through the fuser belt to form a fixing nip therebetween, through which a recording medium travels under heat and pressure as the pressure member rotates to rotate the fuser belt; and a reinforcing member disposed inside the loop of the fuser belt to reinforce the fuser pad against pressure from the pressure member, the fuser pad comprising:

an elongated base defining a smooth surface on a front side thereof facing the pressure member;

multiple longitudinally spaced protrusions on a rear side of the elongated base opposite the front side thereof, the multiple longitudinally spaced protrusions contacting the reinforcing member;

a perforated, anti-friction cover wrapped around the elongated base to reduce friction between the fuser pad and the fuser belt, the cover defining one or more openings for inserting therethrough the protrusions on the rear side of the elongated base; and a fastener disposed between the protrusions on the rear side of the elongated base to fasten the cover in position around the elongated base.

2. The fixing device according to claim 1, wherein heights of the protrusions in the load direction decrease with increasing distance from a longitudinal center of the elongated base and decreasing distance from a longitudinal end of the elongated base.

3. The fixing device according to claim 2, wherein a difference between the heights of central and peripheral protrusions at the longitudinal center and the longitudinal end, respectively, of the elongated base substantially equals an amount of deformation by which the reinforcing member is deformed by the pressure member.

4. The fixing device according to claim 2, wherein a difference between the heights of central and peripheral protrusions at the longitudinal center and the longitudinal end, respectively, of the elongated base falls within a range between approximately 0.3 millimeters and approximately 0.48 millimeters.

5. The fixing device according to claim 1, wherein spacing between two adjoining protrusions of the fuser pad falls within a range between approximately 6 millimeters and approximately 14 millimeters.

6. The fixing device according to claim 1, further comprising a perforated attachment having one or more openings therein for inserting therethrough the protrusions of the fuser pad, while fastened together with the anti-friction cover on the rear side of the elongated base.

7. An image forming apparatus, comprising:

an electrophotographic imaging unit to form a toner image on a recording medium; and a fixing device to fix the toner image in place on the recording medium, the fixing device comprising:

a tubular belt holder;

a rotatable, flexible fuser belt looped for rotation around the belt holder;

a heater disposed adjacent to the belt holder to heat the belt holder to in turn heat the fuser belt;

a fuser pad accommodated in the belt holder inside the loop of the fuser belt, and extending in an axial direction of the belt holder;

a pressure member disposed opposite the belt holder with the fuser belt interposed between the fuser pad and the pressure member, the pressure member pressing in a load direction against the fuser pad through the fuser belt to form a fixing nip therebetween, through which the recording medium travels under heat and pressure as the pressure member rotates to rotate the fuser belt; and a reinforcing member disposed inside the loop of the fuser belt to reinforce the fuser pad under pressure from the pressure member, the fuser pad comprising:

an elongated base defining a smooth surface on a front side thereof facing the pressure member;

multiple longitudinally spaced protrusions on a rear side of the elongated base opposite the front side thereof, the multiple longitudinally spaced protrusions contacting the reinforcing member;

a perforated, anti-friction cover wrapped around the elongated base to reduce friction between the fuser pad and the fuser belt, the cover defining one or more openings for inserting therethrough the protrusions on the rear side of the elongated base; and a fastener disposed between the protrusions on the rear side of the elongated base to fasten the cover in position around the elongated base.

8. A fixing device comprising:

a rotatable, flexible fuser belt forming a loop;

a heater heat the fuser belt;

a fuser pad inside the loop of the fuser belt;

a rotatably driven pressure member, with the fuser belt interposed between the fuser pad and the pressure member, the pressure member pressing in a load direction against the fuser pad through the fuser belt to form a fixing nip therebetween, through which a recording medium travels under heat and pressure as the pressure member rotates to rotate the fuser belt; and a reinforcing member disposed inside the loop of the fuser belt to reinforce the fuser pad against pressure from the pressure member, the fuser pad comprising:

an elongated base defining a smooth surface on a front side thereof facing the pressure member;

multiple longitudinally spaced protrusions on a rear side of the elongated base opposite the front side thereof, the multiple longitudinally spaced protrusions contacting the reinforcing member;

a perforated, anti-friction cover wrapped around the elongated base to reduce friction between the fuser pad and the fuser belt, the cover defining one or more openings for inserting therethrough the protrusions on the rear side of the elongated base; and a fastener disposed between the protrusions on the rear side of the elongated base to fasten the cover in position around the elongated base.

* * * * *